US008006505B2

(12) United States Patent
Yabu

(10) Patent No.: US 8,006,505 B2
(45) Date of Patent: Aug. 30, 2011

(54) AIR CONDITIONING APPARATUS

(75) Inventor: Tomohiro Yabu, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 494 days.

(21) Appl. No.: 12/278,546

(22) PCT Filed: Feb. 14, 2007

(86) PCT No.: PCT/JP2007/052591

§ 371 (c)(1),
(2), (4) Date: Aug. 6, 2008

(87) PCT Pub. No.: WO2007/094349

PCT Pub. Date: Aug. 23, 2007

(65) Prior Publication Data

US 2009/0007578 A1 Jan. 8, 2009

(30) Foreign Application Priority Data

Feb. 17, 2006 (JP) ..... 2006-041215

(51) Int. Cl.
*G01K 13/00* (2006.01)
*F25B 45/00* (2006.01)
*A62C 3/07* (2006.01)

(52) U.S. Cl. ..... 62/129; 62/77; 169/62

(58) Field of Classification Search ..... 62/190, 62/77, 129; 169/46, 62
See application file for complete search history.

(56) References Cited

U.S. PATENT DOCUMENTS

| | | | | |
|---|---|---|---|---|
| 5,515,691 | A * | 5/1996 | Wertenbach et al. | 62/133 |
| 5,934,379 | A | 8/1999 | Ostlyngen et al. | |
| 2001/0025496 | A1 | 10/2001 | Bimboes et al. | |

FOREIGN PATENT DOCUMENTS

| | | | |
|---|---|---|---|
| CN | 1138770 | A | 12/1996 |
| CN | 1082823 | C | 4/2002 |
| CN | 2690198 | Y | 4/2005 |
| EP | 0730128 | A1 | 9/1996 |
| JP | S49-146561 | U | 4/1973 |
| JP | S51-131200 | A | 11/1976 |
| JP | S56-001068 | U | 6/1980 |
| JP | H06-054924 | A | 3/1994 |
| JP | H07-293927 | A | 11/1995 |
| JP | H09-135917 | A | 5/1997 |
| JP | H10-078242 | A | 3/1998 |
| JP | H10-248954 | A | 9/1998 |
| JP | H10-511018 | A | 10/1998 |
| JP | 2001-280762 | A | 10/2001 |
| JP | 2003-038673 | A | 2/2003 |
| KR | 20-0300639 | Y1 | 1/2003 |
| WO | WO-96/16699 | | 6/1996 |

OTHER PUBLICATIONS

Korean Office Action of corresponding Korean Patent Application No. 10-2008-7021120 dated Jul. 16, 2010.

* cited by examiner

*Primary Examiner* — Chen-Wen Jiang
(74) *Attorney, Agent, or Firm* — Global IP Counselors

(57) ABSTRACT

An air conditioning apparatus includes a vapor compression refrigerant circuit that uses carbon dioxide as a refrigerant, an electric component assembly for controlling an operation for structural devices, and a refrigerant emission pipe capable of emitting carbon dioxide from the refrigerant circuit to the electric component assembly.

18 Claims, 22 Drawing Sheets

AIR CONDITIONING APPARATUS

CROSS-REFERENCE TO RELATED APPLICATIONS

This U.S. National stage application claims priority under 35 U.S.C. §119(a) to Japanese Patent Application No. 2006-041215, filed in Japan on Feb. 17, 2006, the entire contents of which are hereby incorporated herein by reference.

TECHNICAL FIELD

The present invention relates to an air conditioning apparatus, and particularly to an air conditioning apparatus comprising electric component assembly for controlling the operations of structural devices.

BACKGROUND ART

Within the field of air conditioning apparatuses comprising electric component assembly, a technique has been disclosed in which the frames of the electric component assembly and its attached components are configured from a flame-retardant material (see Japanese Laid-open Patent Application Nos. 7-293927 and 10-78242).

SUMMARY OF THE INVENTION

An air conditioning apparatus such as is described above has the effect of preventing to the extent possible the spread of fire to the other components of the indoor units when the electric component assembly ignites due to an abnormal temperature increase, but such an air conditioning apparatus does not have the function of proactively extinguishing the fire.

An object of the present invention is to provide an air conditioning apparatus having the function of extinguishing fire when the electric component assembly ignites.

The air conditioning apparatus according to a first aspect comprises a vapor compression refrigerant circuit that uses carbon dioxide as a refrigerant; an electric component assembly for controlling operations of structural devices; and a refrigerant emission means capable of emitting the carbon dioxide from the refrigerant circuit to the electric component assembly.

According to this air conditioning apparatus, carbon dioxide is used as the refrigerant, and, moreover, the carbon dioxide is able to be emitted from the refrigerant circuit to the electric component assembly; therefore, fire extinguishing can be performed when the electric component assembly ignites.

The air conditioning apparatus according to a second aspect is the air conditioning apparatus according to the first aspect, further comprising a detection sensor for sensing a quantity of state resulting from an abnormal temperature increase in the electric component assembly; and a emission control means for performing a refrigerant emission control, wherein a decision is made as to whether or not the abnormal temperature increase has occurred in the electric component assembly on the basis of the quantity of state sensed by the detection sensors, and the refrigerant emission means is operated so that the carbon dioxide is emitted from the refrigerant circuit to the electric component assembly when the decision has been made that the abnormal temperature increase has occurred in the electric component assembly.

According to this air conditioning apparatus, since it is determined whether or not the abnormal temperature increase has occurred in the electric component assembly on the basis of the quantity of state resulting from the abnormal temperature increase in the electric component assembly, it is possible to appropriately determine whether or not the electric component assembly has ignited, and to perform fire extinguishing on the electric component assembly.

The air conditioning apparatus according to a third aspect is the air conditioning apparatus according to the first or second aspect, wherein the refrigerant emission means is operated so that the carbon dioxide is emitted intermittently from the refrigerant circuit.

According to this air conditioning apparatus, since carbon dioxide is emitted intermittently from the refrigerant circuit, it is possible to control so that a large amount of carbon dioxide is not emitted in a short amount of time.

The air conditioning apparatus according to a fourth aspect is the air conditioning apparatus according to the second or third aspect, the refrigerant emission control is such that after the refrigerant emission means is operated so that carbon dioxide is emitted from the refrigerant circuit to the electric component assembly, a decision is made as to whether or not the abnormal temperature increase in the electric component assembly has been suppressed on the basis of the quantity of state detected by the detection sensor, and when a decision has been made that the abnormal temperature increase in the electric component assembly has not been suppressed, the refrigerant emission means is operated so that the amount of carbon dioxide emitted increases further.

According to this air conditioning apparatus, after it is determined that the abnormal temperature increase in the electric component assembly has occurred and carbon dioxide begins to be emitted from the refrigerant circuit, the decision is made as to whether or not the abnormal temperature increase in the electric component assembly has been suppressed, and when it is determined that the abnormal temperature increase in the electric component assembly has not been suppressed, the control is performed so that the amount of carbon dioxide emitted increases; therefore, it is possible to emit the amount of carbon dioxide suitable for extinguishing fire in the electric component assembly while ensuring the effect of suppressing the abnormal temperature increase in the electric component assembly.

The air conditioning apparatus according to a fifth aspect is the air conditioning apparatus according to any of the second through fourth aspects, wherein the refrigerant emission control is such that after the refrigerant emission means is operated so that carbon dioxide is emitted from the refrigerant circuit to the electric component assembly, a decision is made as to whether or not the abnormal temperature increase in the electric component assembly has been suppressed on the basis of the quantity of state detected by the detection sensor, and when it is determined that the abnormal temperature increase in the electric component assembly has been suppressed, the refrigerant emission control is ended.

According to this air conditioning apparatus, after it is determined that the abnormal temperature increase has occurred in the electric component assembly and carbon dioxide has been emitted from the refrigerant circuit, the decision is made as to whether or not the abnormal temperature increase in the electric component assembly has been suppressed, and when it is determined that the abnormal temperature increase in the electric component assembly has been suppressed, the emission of carbon dioxide is ended; therefore, it is possible to reliably perform fire extinguishing on the electric component assembly.

The air conditioning apparatus according to a sixth aspect is the air conditioning apparatus according to any of the second through fifth aspects, wherein the detection sensor is a temperature sensor for sensing a temperature of the electric component assembly.

According to this air conditioning apparatus, since temperature sensor for sensing the temperature of the electric component assembly is used as the detection sensor, the occurrence of the abnormal temperature increase in the electric component assembly can be reliably detected.

The air conditioning apparatus according to a seventh aspect is the air conditioning apparatus according to any of the first through sixth aspects, wherein the refrigerant emission means has a discharge nozzle connected to the refrigerant circuit, and a discharge valve connected to the discharge nozzle.

According to this air conditioning apparatus, carbon dioxide can be emitted from the refrigerant circuit to the electric component assembly by setting the discharge valve in an open state.

The air conditioning apparatus according to an eighth aspect is the air conditioning apparatus according to the seventh aspect, wherein the discharge nozzle opens into the electric component assembly.

According to this air conditioning apparatus, since the discharge nozzle opens into the electric component assembly, carbon dioxide can be blown directly onto electric component that are likely to be the cause of abnormal temperature increase, and fire extinguishing for the electric component assembly can be performed effectively.

The air conditioning apparatus according to a ninth aspect is the air conditioning apparatus according to the seventh or eighth aspect, wherein also connected to the discharge nozzle is an oil separation means that can separate refrigerator oil from the carbon dioxide when the carbon dioxide is emitted from the refrigerant circuit to the electric component assembly.

According to this air conditioning apparatus, since oil separation means is also connected to the discharge nozzles, carbon dioxide can be emitted from the refrigerant circuit to the electric component assembly with as little emission of refrigerator oil as possible.

The air conditioning apparatus according to a tenth aspect is the air conditioning apparatus according to any of the first through ninth aspects, wherein the refrigerant circuit is configured by connecting an indoor unit and an outdoor unit via a refrigerant communication pipe; and the refrigerant emission means is provided to the indoor unit and/or the outdoor unit.

According to this air conditioning apparatus, since the refrigerant emission means is provided to the indoor unit and/or the outdoor unit, fire extinguishing can be performed when ignition occurs in the electric component assembly provided to the indoor unit and/or the electric component assembly provided to the outdoor unit.

The air conditioning apparatus according to an eleventh aspect is the air conditioning apparatus according to any of the first through tenth aspects, wherein the refrigerant circuit is configured by connecting an indoor unit and an outdoor unit via the refrigerant communication pipe. An interior of the outdoor unit is provided with a refrigerant storage container for storing carbon dioxide as a refrigerant, the refrigerant storage container being communicably or blockably connected to the refrigerant circuit. This air conditioning apparatus further comprises a refrigerant filling control means which performs a refrigerant filling operation in which a refrigeration cycle operation of the refrigerant circuit is performed in a state in which the refrigerant storage container is made to communicate with the refrigerant circuit, whereby the refrigerant circuit is filled with the carbon dioxide inside the refrigerant storage container until the amount of the refrigerant in the refrigerant circuit reaches a specific amount. The refrigerant filling control means performs the refrigerant filling operation after the emission of the carbon dioxide by the refrigerant emission means is ended.

According to this air conditioning apparatus, since the refrigerant storage container is provided in order to perform the refrigerant filling operation for filling the refrigerant circuit with carbon dioxide until the amount of the refrigerant in the refrigerant circuit reaches the specific amount, and, moreover, since the refrigerant filling operation can be performed even after carbon dioxide is emitted from the refrigerant circuit to the electric component assembly and fire extinguishing for the electric component assembly is ended, the refrigerant circuit can be replenished with carbon dioxide from the refrigerant storage container in which an amount proportionate to the amount reduced by emission from the refrigerant circuit.

The air conditioning apparatus according to a twelfth aspect is the air conditioning apparatus according to any of the first through tenth aspects, wherein the refrigerant circuit is configured by connecting an indoor unit and an outdoor unit via a refrigerant communication pipe. An interior of the outdoor unit is provided with a refrigerant storage container for storing carbon dioxide as a refrigerant, the refrigerant storage container being communicably or blockably connected to the refrigerant circuit. This air conditioning apparatus further comprises refrigerant filling control means which performs a refrigerant filling operation in which a refrigeration cycle operation of the refrigerant circuit is performed in a state in which the refrigerant storage container is made to communicate with the refrigerant circuit, whereby the refrigerant circuit is filled with the carbon dioxide inside the refrigerant storage container until the amount of the refrigerant in the refrigerant circuit reaches a specific amount. The refrigerant filling control means allows the carbon dioxide in the refrigerant storage container to flow into the refrigerant circuit during the emission of the carbon dioxide by the refrigerant emission means.

According to this air conditioning apparatus, since the refrigerant storage container is provided in order to perform the refrigerant filling operation for filling the refrigerant circuit with carbon dioxide until the amount of the refrigerant in the refrigerant circuit reaches the specific amount, the refrigerant circuit can be replenished with carbon dioxide from the refrigerant storage container when the carbon dioxide is emitted from the refrigerant circuit to the electric component assembly.

The air conditioning apparatus according to a thirteenth aspect is the air conditioning apparatus according to any of the first through twelfth aspects, wherein the refrigerant circuit is configured by connecting a compressor, a cooler, an expansion mechanism, and an evaporator. This air conditioning apparatus further comprises a blowing fan for blowing air as a heat source to the cooler and/or the evaporator. The blowing fan and the compressor are stopped when the carbon dioxide is emitted by the refrigerant emission means.

According to this air conditioning apparatus, since carbon dioxide is emitted by the refrigerant emission means in a state in which the blowing fan and the compressor have been stopped, fire extinguishing can be performed on the electric component assembly in a state in which air is not readily supplied to the electric component assembly, and in a state in which heat generation in the electric component assembly is prevented as much as possible.

The air conditioning apparatus according to a fourteenth aspect is the air conditioning apparatus according to any of the first through twelfth aspects, wherein the refrigerant circuit is configured by connecting a compressor, a cooler, an expansion mechanism, and an evaporator. This air conditioning apparatus further comprises a blowing fan for blowing air as a heat source to the cooler and/or the evaporator. Of the blowing fan and the compressor, the emission control means stops only the blowing fan when the carbon dioxide is emitted by the refrigerant emission means.

According to this air conditioning apparatus, since carbon dioxide is emitted by the refrigerant emission means in a state in which the compressor is operated and in a state in which the blowing fan is stopped, fire extinguishing can be performed on the electric component assembly in a state in which air is not readily supplied to the electric component assembly, and in a state in which the carbon dioxide flowing through the refrigerant circuit can be kept at the highest pressure possible and the amount emitted can be increased.

The air conditioning apparatus according to a fifteenth aspect is the air conditioning apparatus according to any of the first through twelfth aspects, wherein the refrigerant circuit is configured by connecting a compressor, a cooler, an expansion mechanism, and an evaporator. This air conditioning apparatus further comprises a blowing fan for blowing air as a heat source to the cooler and/or the evaporator. The blowing fan is driven by a fan drive motor. The refrigerant emission means is capable of emitting the carbon dioxide from the refrigerant circuit to the fan drive motor. According to this air conditioning apparatus, the refrigerant emission means is operated so that the carbon dioxide is emitted from the refrigerant circuit to the fan drive motors when a decision has been made that the blowing fan has locked.

According to this air conditioning apparatus, since carbon dioxide can be emitted from the refrigerant circuit to the fan drive motor when the blowing fan has locked, the blowing fan can be protected.

The air conditioning apparatus according to a sixteenth aspect is the air conditioning apparatus according to any of the first through twelfth aspects, wherein the refrigerant circuit is configured by connecting a compressor, a cooler, an expansion mechanism, and an evaporator. The compressor is driven by a built-in compressor drive motor. The refrigerant emission means is capable of emitting the carbon dioxide from the refrigerant circuit to the compressor. According to this air conditioning apparatus, the refrigerant emission means is operated so that the carbon dioxide is emitted from the refrigerant circuit to the compressor when a decision has been made that the compressor has locked.

According to this air conditioning apparatus, since the carbon dioxide can be emitted from the refrigerant circuit to the compressor when the compressor has locked, the compressor can be protected.

The air conditioning apparatus according to a seventeenth aspect is the air conditioning apparatus according to any of the first through sixteenth aspects, wherein the refrigerant emission means is capable of emitting the carbon dioxide to the electric component assembly from a high-pressure portion of the refrigerant circuit through which high-pressure refrigerant flows during a refrigeration cycle operation, or from a low-pressure portion of the refrigerant circuit through which low-pressure refrigerant flows during the refrigeration cycle operation.

According to this air conditioning apparatus, since the carbon dioxide can be emitted to the electric component assembly from the high-pressure portion of the refrigerant circuit through which high-pressure refrigerant flows during the refrigeration cycle operation, or from the low-pressure portion of the refrigerant circuit through which low-pressure refrigerant flows during the refrigeration cycle operation, a large amount of the carbon dioxide can be emitted in a short amount of time when emitted from the high-pressure portion, and the carbon dioxide can be emitted continuously over a long period of time when emitted from the low-pressure portion.

The air conditioning apparatus according to an eighteenth aspect is the air conditioning apparatus according to any of the first through sixteenth aspects, wherein the refrigerant emission means is capable of emitting the carbon dioxide to the electric component assembly from a high-pressure portion of the refrigerant circuit through which high-pressure refrigerant flows during a refrigeration cycle operation, and from a low-pressure portion of the refrigerant circuit through which low-pressure refrigerant flows during the refrigeration cycle operation.

According to this air conditioning apparatus, since the carbon dioxide can be emitted to the electric component assembly from the high-pressure portion of the refrigerant circuit through which high-pressure refrigerant flows during the refrigeration cycle operation, and from a low-pressure portion of the refrigerant circuit through which low-pressure refrigerant flows during the refrigeration cycle operation, a larger amount of the carbon dioxide can be emitted in a short amount of time in comparison with cases in which the carbon dioxide is emitted from either one of the high-pressure portion or low-pressure portion.

DETAILED DESCRIPTION OF THE INVENTION

Embodiments of an air conditioning apparatus according to the present invention are described hereinbelow with reference to the drawings.

Embodiment 1

(1) Configuration of Air Conditioning Apparatus

Figure 1:
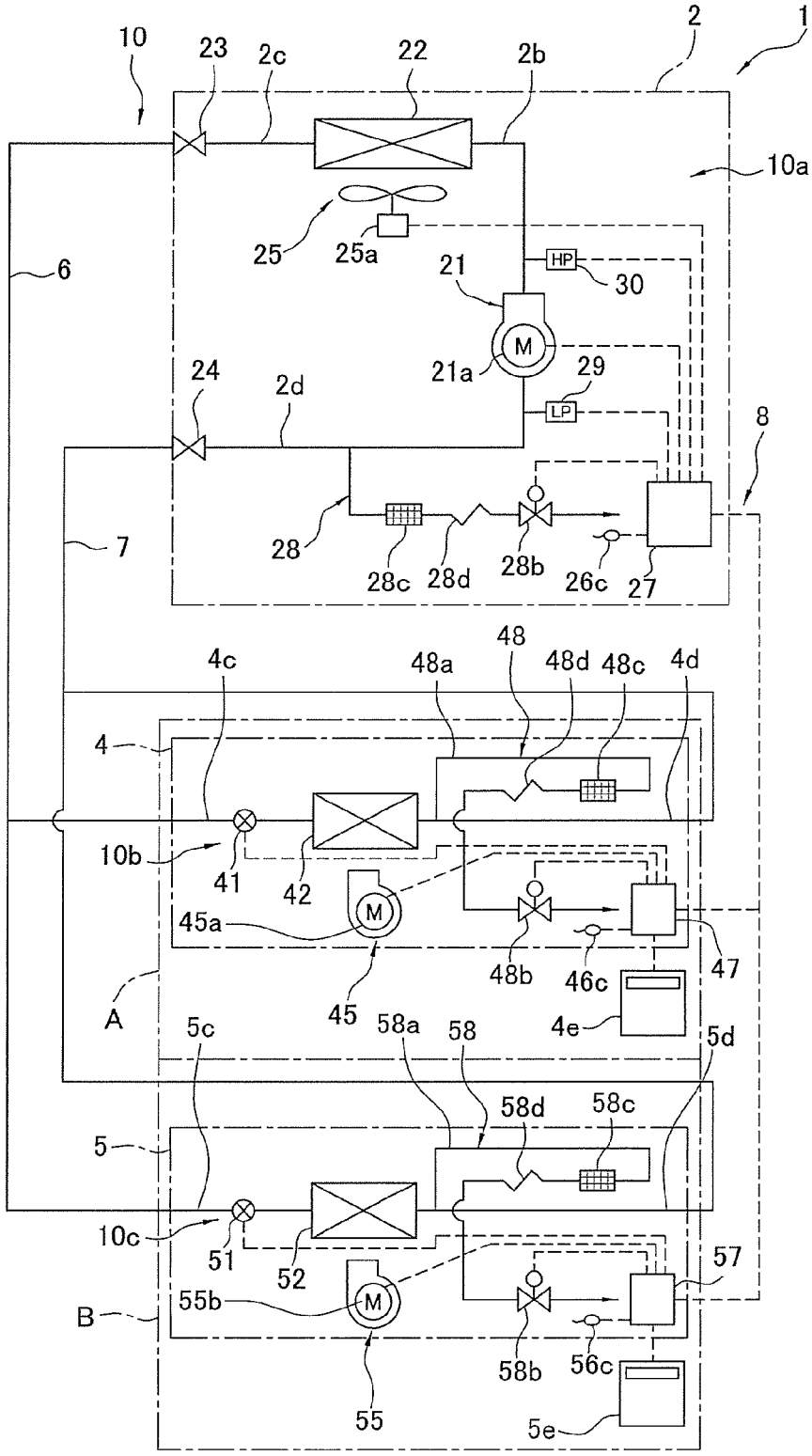
FIG. 1 is a schematic structural view of an air conditioning apparatus according to Embodiment 1 of the present invention.

FIG. 1 is a schematic structural view of an air conditioning apparatus 1 according to embodiment 1 of the present invention. The air conditioning apparatus 1 is an apparatus used to cool the interior of a building or the like by performing a vapor compression-type refrigeration cycle operation. The air conditioning apparatus 1 mainly includes an outdoor unit 2, a plurality (two in this case) of indoor units 4, 5, and refrigerant communication pipes 6, 7 for connecting the outdoor unit 2 with the indoor units 4, 5. Specifically, a vapor compression refrigerant circuit 10 of the air conditioning apparatus 1 of the present embodiment is configured by connecting the outdoor unit 2, the indoor units 4, 5, and the refrigerant communication pipes 6, 7. Carbon dioxide ($CO_2$) is filled as a refrigerant with refrigerator oil in the refrigerant circuit 10 of the air conditioning apparatus 1, and for example, a refrigerant cycle operation that the refrigerant in the refrigerant circuit 10 is compressed to a pressure exceeding critical pressure, cooled, reduced in pressure, vaporized, and then compressed again is performed as described later.

(Indoor Unit)

The indoor units 4, 5 are connected to the outdoor unit 2 via the refrigerant communication pipes 6, 7, and constitute part of the refrigerant circuit 10. In the present embodiment, the indoor unit 4 is disposed for the air-conditioning of a first space A, and the indoor unit 5 is disposed for the air-conditioning of a second space B.

Figure 2:
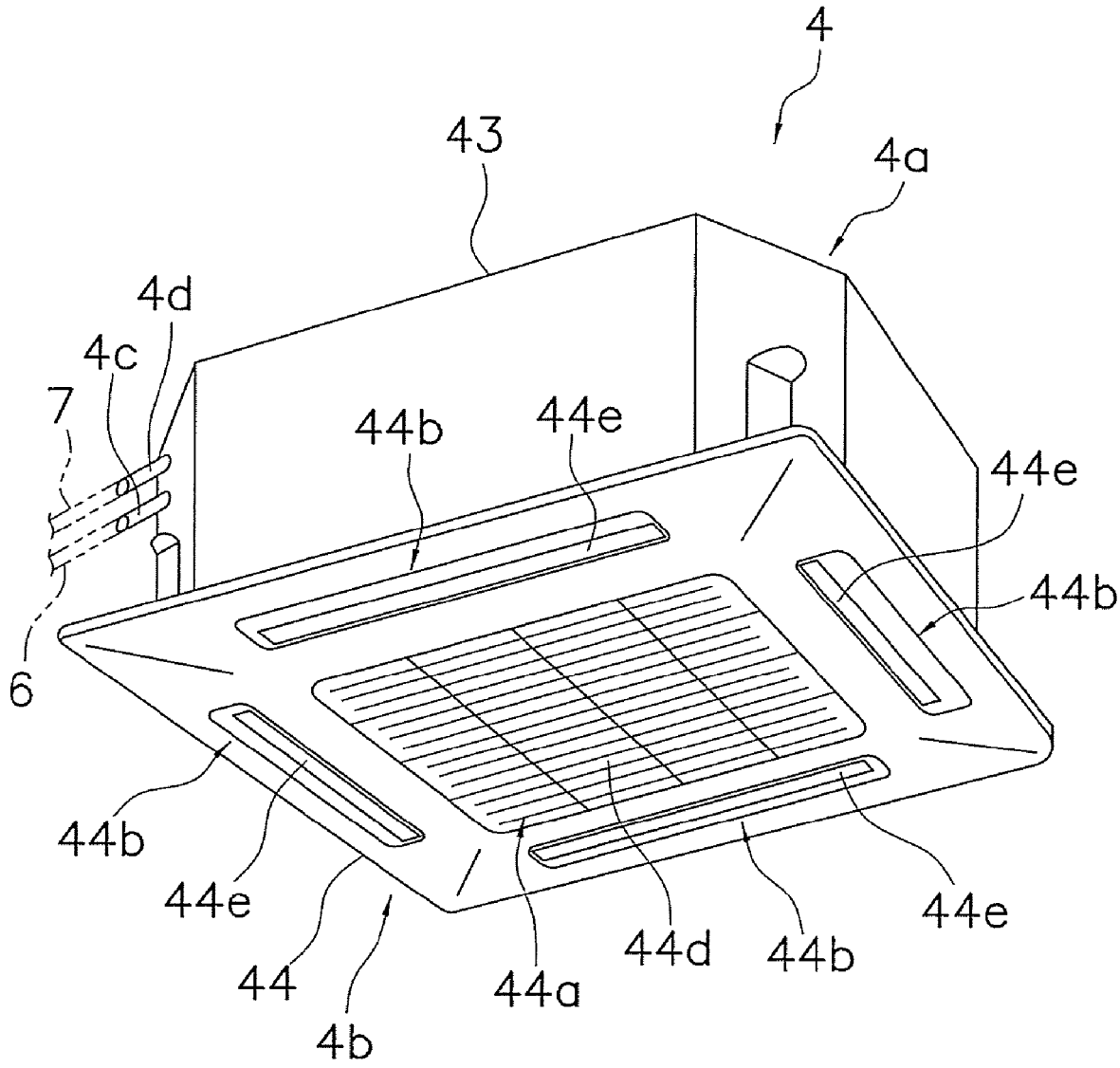
FIG. 2 is an external perspective view of an indoor unit according to Embodiment 1.
Figure 3:
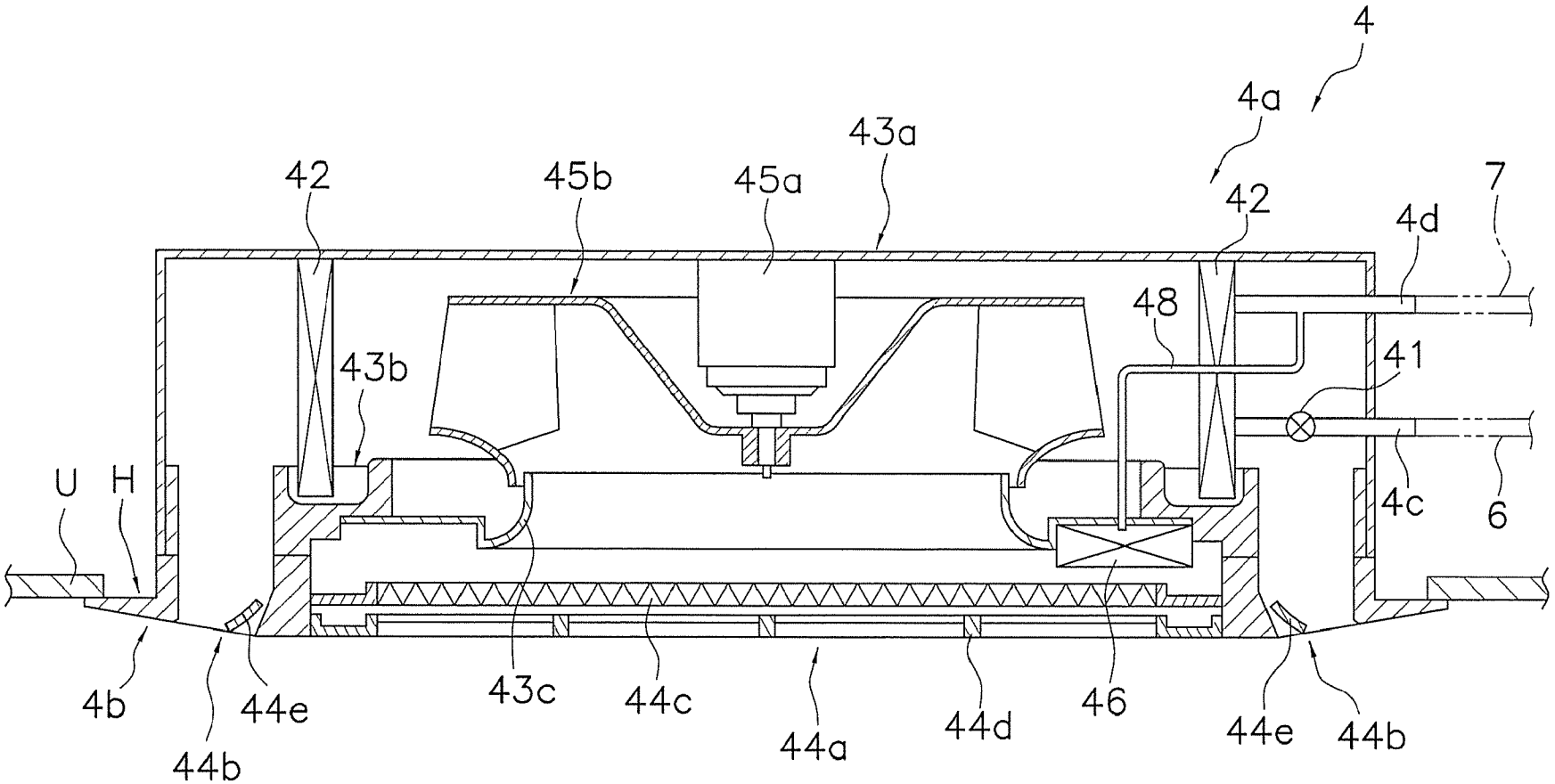
FIG. 3 is a schematic cross-sectional side view of the indoor unit according to Embodiment 1 (a refrigerant emission pipe and refrigerant pipes are depicted schematically).
Figure 4:
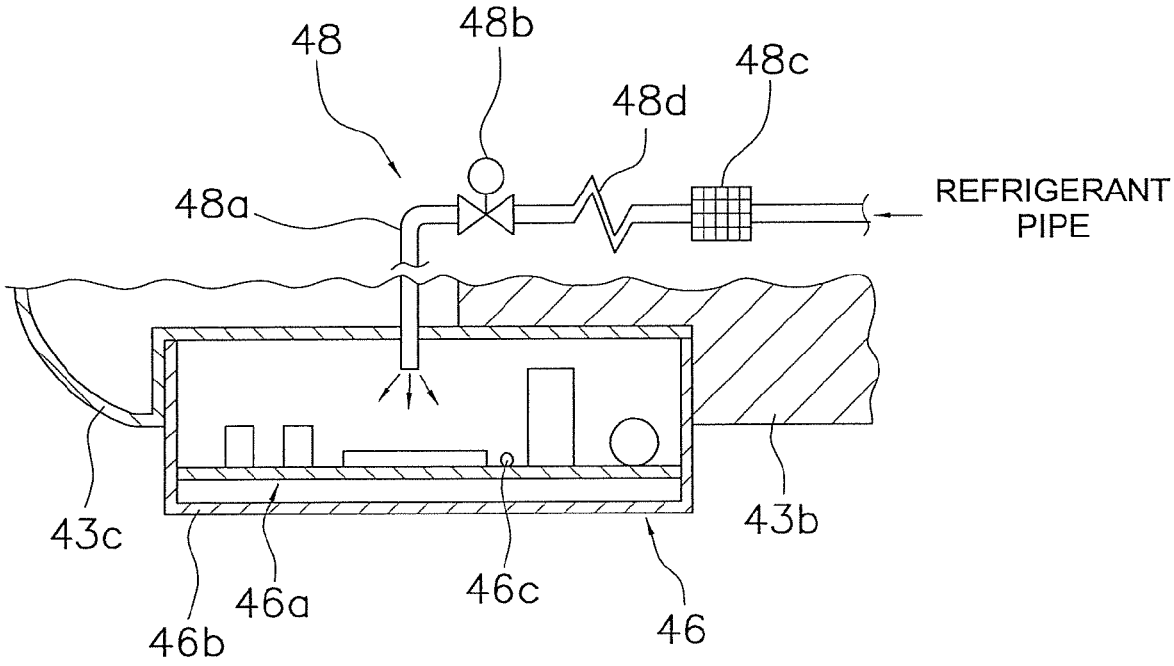
FIG. 4 is a drawing showing the schematic configuration of the refrigerant emission pipe and an electric component assembly in FIG. 3 (the refrigerant emission pipe is depicted schematically).

Next, the configuration of the indoor units 4, 5 will be described using FIGS. 1 through 4. FIG. 2 is an external perspective view of the indoor unit 4. FIG. 3 is a schematic cross-sectional side view of the indoor unit 4 (a refrigerant emission pipe 48 and refrigerant pipes 4*c*, 4*d* are depicted schematically). FIG. 4 is a drawing showing the schematic configuration of the refrigerant emission pipe 48 (described later) and the electric component assembly 46 (described later) in FIG. 3 (the refrigerant emission pipe 48 is depicted schematically). Since the indoor unit 4 and the indoor unit 5 have the same configuration, only the configuration of the indoor unit 4 will be described, and for the configuration of the indoor unit 5, the numerical symbols in the 40s denoting the components of the indoor unit 4 are replaced by numerical symbols in the 50s, and descriptions of these components are omitted.

The indoor unit 4 is provided with an indoor-side refrigerant circuit 10*b* (an indoor-side refrigerant circuit 10*c* in the indoor unit 5) constituting part of the refrigerant circuit 10. This indoor-side refrigerant circuit 10*b* mainly has an indoor expansion valve 41 as an expansion mechanism, and an indoor heat exchanger 42 as an evaporator.

The indoor expansion valve 41 is an electrical expansion valve that is connected to the indoor heat exchanger 42 and whose degree of opening can be adjusted to reduce the pressure of the refrigerant in accordance with the state of operation.

The indoor heat exchanger 42 is a heat exchanger capable of performing heat exchange between the indoor air and the refrigerant, the heat exchanger being connected to the indoor expansion valve 41 at one end and to the refrigerant communication pipe 7 at the other end.

Next, the unit configuration of the indoor unit 4 will be described.

The indoor unit 4 is a ceiling-embedded air conditioning unit for taking in indoor air, performing heat exchange, and then supplying the air into the room. The indoor unit 4 mainly has a unit body 4*a* having a casing 43 and various structural devices housed within the casing 43, and a face panel 4*b* mounted on the bottom surface of the unit body 4*a*. The unit body 4*a* is inserted into an opening H formed in the ceiling U of the air-conditioned room and is disposed in a space behind the ceiling. The face panel 4*b* is disposed so as to cover the space H from below.

The casing 43 mainly has a substantially rectangular box-shaped casing body 43*a* having an opening in the bottom surface, and a drain pan 43*b* mounted on the bottom of the casing body 43*a* so as to cover the opening in the bottom surface of the casing body 43*a*. The refrigerant pipes 4*c*, 4*d* for exchanging the refrigerant with the outdoor unit 2 are provided so as to pass through the side surfaces of the casing body 43*a*. The refrigerant pipe 4*c* is connected to the refrigerant communication pipe 6, and the refrigerant pipe 4*d* is connected to the refrigerant communication pipe 7. The indoor expansion valve 41 is provided to the refrigerant pipe 4*c*.

The primary components disposed inside the casing 43 are an indoor fan 45 as a blowing fan for taking indoor air into the casing 43 through an intake port 44*a* in the face panel 4*b* and blowing the air out in the circumferential direction, and the indoor heat exchanger 42 is disposed so as to enclose the external periphery of the indoor fan 45. In the present embodiment, the indoor fan 45 is a turbofan, and has a fan drive motor 45*a* provided in the inside surface in the center of the ceiling of the casing body 43*a*, and an impeller 45*b* linked to the fan drive motor 45*a* and rotatably driven. In the present embodiment, the indoor heat exchanger 42 is a cross-fin tube type heat exchange panel bent and formed so as to enclose the external periphery of the indoor fan 45, and is connected to the refrigerant pipes 4*c*, 4*d*. The drain pan 43*b* is placed below the indoor heat exchanger 42 and is designed to be capable of receiving drain water resulting from the condensation of moisture in the air in the indoor heat exchanger 42. An intake hole is formed in the drain pan 43*b* so as to face the impeller 45*b* of the indoor fan 45, and a plurality (four in this case) of discharge holes are formed along the inside surfaces of the side plates of the casing body 43*a*. The intake hole of the drain pan 43*b* is provided with a bell mouth 43*c* for guiding indoor air taken in through the intake port 44*a* of the face panel 4*b* to the impeller 45*b* of the indoor fan 45.

The electric component assembly 46 for performing operation control for the structural devices is provided in the bottom surface of the bell mouth 43*c*. The electric component assembly 46 mainly has electric components such as a control board 46*a* in which are installed a microcomputer, memory, and the like, provided to perform control for the indoor unit 4; and a substantially box-shaped frame 46*b* for holding these electric components. The electric component assembly 46 is also provided with an electric component temperature sensor 46*c* for sensing the temperature of the electric component assembly 46 (the temperature inside the frame 46*b* in this case). In the present embodiment, the electric component temperature sensor 46*c* is composed of a thermistor. The electric component assembly 46 functions as an indoor-side control unit 47 for controlling the operations of the components constituting the indoor unit 4; and is designed to be capable of exchanging control signals and the like with a remote controller 4*e* for operating the indoor unit 4, as well as exchanging control signals and the like with the outdoor unit 2.

Figure 5:
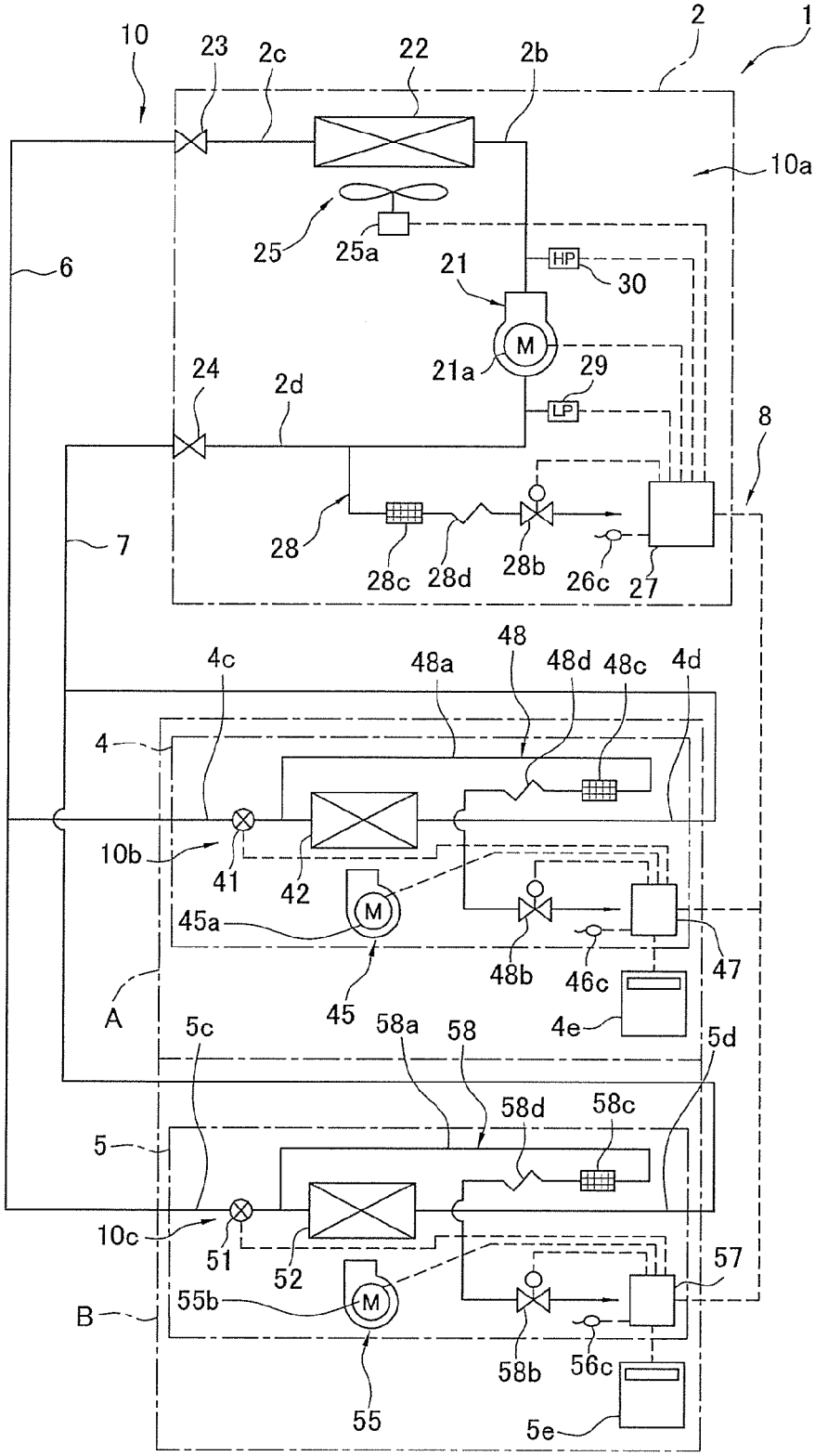
FIG. 5 is a schematic structural drawing of the air conditioning apparatus according to Embodiment 1 (an example in which the refrigerant emission pipe is connected to a different refrigerant pipe).

In the present embodiment, connected to the refrigerant pipe 4*d* of the indoor unit 4 is a refrigerant emission pipe 48 as a refrigerant emission means capable of emitting carbon dioxide from the refrigerant circuit 10 (more specifically, from the indoor-side refrigerant circuit 10*b*, and in the indoor unit 5, from the indoor-side refrigerant circuit 10*c*) to the electric component assembly 46. The refrigerant emission pipe 48 mainly has a discharge nozzle 48*a*, and a discharge valve 48*b* connected to the discharge nozzle 48*a*. The discharge nozzle 48*a* is a pipe member connected so as to divert the refrigerant flowing through the refrigerant pipe 4*d*. In the present embodiment, rather than being connected to the refrigerant pipe 4*d* on the outlet side of the indoor heat exchanger 42 that functions as an evaporator, as shown in FIG. 5, the discharge nozzle 48*a* may be connected to the refrigerant pipe 4*c* so as to divert the refrigerant flowing between the indoor expansion valves 41, 51 and the indoor heat exchangers 42, 52. In the present embodiment, the distal end of the discharge nozzle 48*a* is inserted into the electric component assembly 46 (more specifically, into the frame 46*b*) from an opening or the like formed in the bellmouth 43*c* in order to pass a wire connecting the control board 46*a* and fan drive motor 45*a* and the like disposed inside the casing 43, and the distal end of the discharge nozzle 48*a* opens into the electric component assembly 46. The distal end of the discharge nozzle 48*a* is disposed above the control board 46*a* and the other electric components in the present embodiment. The discharge valve 48*b* is a valve that is opened when the refrigerant is emitted from the refrigerant circuit 10 to the electric component assembly 46, and is composed of an electromagnetic valve in the present embodiment. Also connected to the discharge nozzle 48*a* is an oil filter 48*c* as an oil separation means that can separate refrigerator oil from the refrigerant when the refrigerant is emitted from the refrigerant circuit 10 to the electric component assembly 46. The oil filter 48*c* is connected at the upstream side of the discharge valve 48*b* in the present embodiment. Furthermore, connected to the discharge nozzle 48*a* is a capillary tube 48*d* for ensuring that the flow rate of the refrigerant emitted from the discharge nozzle 48*a* does not become excessive when the refrigerant is emitted from the refrigerant circuit 10 to the electric component assembly 46. The capillary tube 48*d* is connected at the upstream side of the discharge valve 48*b* and at the downstream side of the oil filter 48*c* in the present embodiment. The capillary tube 48*d* does not need to be connected to the discharge nozzle 48*a* in cases in which the flow resistance in the discharge nozzle 48*a*, the discharge valve 48*b*, and the oil filter 48*c* is alone sufficient to limit the flow rate of the refrigerant emitted from the discharge nozzle 48*a*. The positions where the oil filter 48*c* and the capillary tube 48*d* are connected are not limited to the connecting positions of the present embodiment, and various other connecting positions can be selected.

The face panel 4*b* is a plate-shaped member having a substantially rectangular shape in a plan view, and mainly has a panel body 44 mounted on the unit body 4*a*. The substantially rectangular intake port 44*a* that takes in indoor air is formed in the substantial middle of the panel body 44, and a plurality (four in this case) of discharge ports 44*b* having a substantially rectangular shape is formed so as to enclose the intake port 44*a*. The intake port 44*a* communicates with the intake hole of the drain pan 43*b*, and the discharge ports 44*b* communicate with the discharge hole of the drain pan 43*b*. A filter 44*c* for capturing dust and the like contained in the indoor air taken in through the intake port 44*a* is disposed in the intake port 44*a* so as to cover the intake port 44*a*, and an intake grill 44*d* is mounted on the bottom side of the filter 44*c*. The discharge ports 44*b* are provided with horizontal flaps 44*e* which make it possible to change the direction of the air being blown out to the room through the discharge ports 44*b*.

As described above, an air flow channel is formed in the indoor unit 4 to extend from the intake port 44*a* of the face panel 4*b* to the discharge ports 44*b* of the face panel 4*b* through the filter 44*c*, the bell mouth 43*c*, the intake hole of the drain pan 43*b*, the indoor fan 45, the indoor heat exchanger 42, and the discharge hole of the drain pan 43*b*. Additionally, in the indoor unit 4, by rotatably driving the indoor fan 45, indoor air is taken in and heat is exchanged in the indoor heat exchanger 42, and the air can then be blown downward out into the room. Since the refrigerant emission pipe 48 is provided in this indoor unit 4, opening the discharge valve 48*b* of the refrigerant emission pipe 48, when the electric component assembly 46 ignites, allows the carbon dioxide as the refrigerant to be emitted from the refrigerant circuit 10 to the electric component assembly 46 to extinguish or cool the fire.

(Outdoor Unit)

The outdoor unit 2 is connected to the indoor units 4, 5 via the refrigerant communication pipes 6, 7, and constitutes the refrigerant circuit 10 between the indoor units 4, 5.

Figure 6:
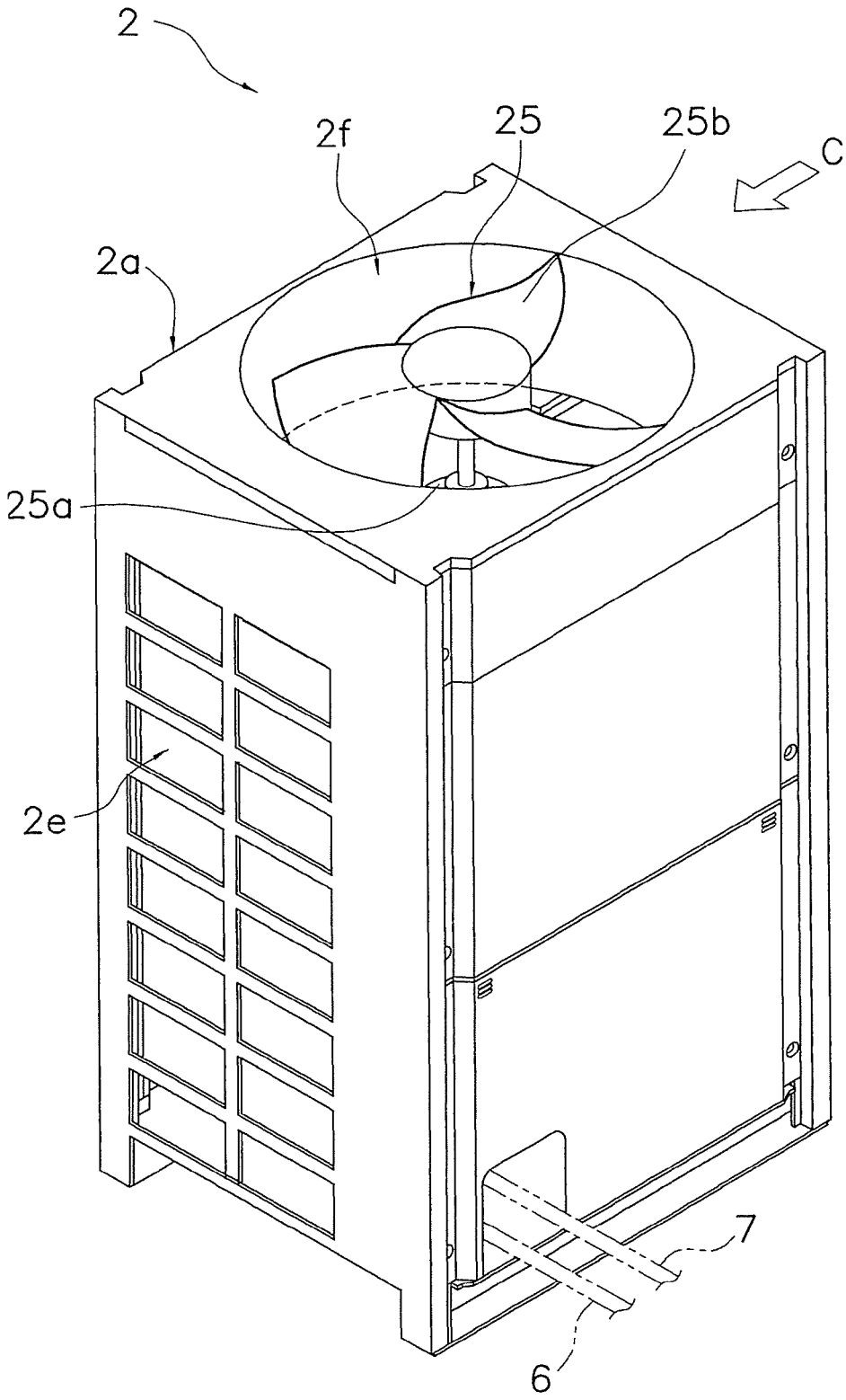
FIG. 6 is an external perspective view of an outdoor unit according to Embodiment 1.
Figure 7:
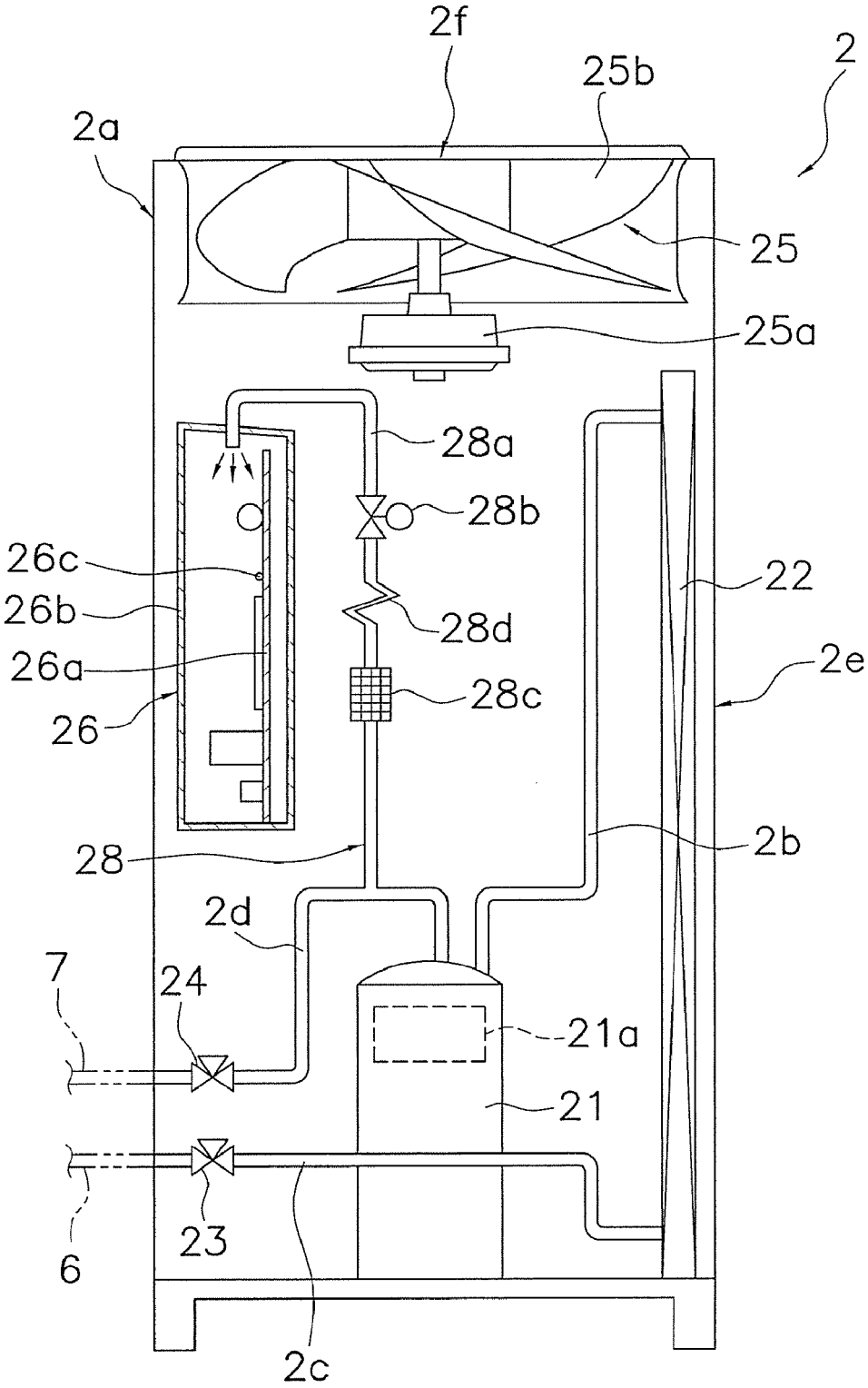
FIG. 7 is a schematic cross-sectional side view of the outdoor unit in FIG. 6 as seen from the direction C (the refrigerant emission pipe and the refrigerant pipes are depicted schematically).

Next, the configuration of the outdoor unit 2 will be described using FIGS. 1, 6, and 7. FIG. 6 is an external perspective view of the outdoor unit 2. FIG. 7 is a schematic cross-sectional side view of the outdoor unit 2 in FIG. 6 as seen from the direction C (a refrigerant emission pipe 28 and refrigerant pipes 2*b*, 2*c*, 2*d* are depicted schematically).

The outdoor unit 2 is provided with an outdoor-side refrigerant circuit 10*a* constituting part of the refrigerant circuit 10.

The outdoor-side refrigerant circuit 10*a* mainly has a compressor 21, an outdoor heat exchanger 22 as a cooler, and shut-off valves 23, 24.

The compressor 21 is a hermetically sealed compressor driven by a compressor drive motor 21*a*. There is only one compressor 21 in the present embodiment, but, not being limited to this option alone, two or more compressors may be connected in parallel according to the number of indoor units connected.

The outdoor heat exchanger 22 is connected at one end to the shut-off valve 24 and at the other end to the discharge side of the compressor 21, and is a heat exchanger capable of performing heat exchange between outdoor air and the refrigerant.

The shut-off valves 23, 24 are valves to which are connected the refrigerant communication pipes 6, 7 for enabling refrigerant exchange between the outdoor unit 2 and the indoor units 4, 5. The shut-off valve 23 is connected to the outdoor heat exchanger 22, and the shut-off valve 24 is connected to the intake side of the compressor 21.

Next, the unit configuration of the outdoor unit 2 will be described.

The outdoor unit 2 is a so-called upward-blowing outdoor unit for taking in air through the side and rear surfaces, conducting heat exchange, and then blowing the air out through the top surface. The outdoor unit 2 mainly has a substantially rectangular parallelepiped-shaped casing 2*a*, and various structural devices housed within the casing 2*a*.

Intake ports 2*e* for taking outdoor air into the casing 2*a* are formed in the side and rear surfaces of the casing 2*a*. A discharge port 2*f* for blowing air out of the casing 2*a* is formed in the top surface of the casing 2*a*.

The primary components disposed inside the casing 2*a* are an outdoor fan 25 as a blowing fan for taking outdoor air into the casing 2*a* and blowing out the air upward, the outdoor heat exchanger 22, the compressor 21, and the shut-off valves 23, 24. In the present embodiment, the outdoor fan 25 is a propeller fan provided in the top of the casing 2*a* so as to face the discharge port 2*f*, and has a fan drive motor 25*a* and an impeller 25*b* connected to the fan drive motor 25*a* and rotatably driven. In the present embodiment, the outdoor heat exchanger 22 is a cross-fin tube type heat exchange panel bent into a substantial U shape and formed in the bottom side of the outdoor fan 25 along the side and rear surfaces (specifically, the intake ports 2*e*) of the casing 2*a*, and the outdoor heat exchanger 22 is connected to the refrigerant pipes 2*b*, 2*c*. The refrigerant pipe 2*b* is herein connected to the discharge side of the compressor 21, and the refrigerant pipe 2*c* is connected to the shut-off valve 23. The compressor 21 is disposed on the bottom surface of the casing 2*a*. The shut-off valves 23, 24 are disposed so as to face the bottom of the front surface of the outdoor unit 2. The shut-off valve 24 is connected with the intake side of the compressor 21 by the refrigerant pipe 2*d*.

The interior of the casing 2*a* is provided with an electric component assembly 26 for performing operation control for the structural devices, the electric component assembly 26 being provided so as to face the front surface of the casing 2*a*. The electric component assembly 26 mainly has electric components such as a control board 26*a* in which are installed a microcomputer, memory, and the like, provided to perform control for the outdoor unit 2, and has a substantially box-shaped frame 26*b* for holding these electric components. The electric component assembly 26 is also provided with an electric component temperature sensor 26*c* for sensing the temperature of the electric component assembly 26 (the temperature inside the frame 26*b* in this case). In the present embodiment, the electric component temperature sensor 26*c* is composed of a thermistor. The outdoor unit 2 is also provided with an intake pressure sensor 29 for sensing the intake pressure of the compressor 21, and a discharge pressure sensor 30 for sensing the discharge pressure Pd of the compressor 21. The electric component assembly 26 functions as an indoor-side control unit 27 for controlling the operations of the components constituting the outdoor unit 2, and is designed to be capable of exchanging control signals and the like with the indoor units 4, 5.

In the present embodiment, the refrigerant emission pipe 28 as an refrigerant emission means capable of emitting carbon dioxide from the refrigerant circuit 10 (more specifically, from the outdoor-side refrigerant circuit 10*a*) to the electric component assembly 26 is connected to the refrigerant pipe 2*d* of the outdoor unit 2. The refrigerant emission pipe 28 mainly has a discharge nozzle 28*a*, and a discharge valve 28*b* connected to the discharge nozzle 28*a*. The discharge nozzle 28*a* is a pipe member connected so as to divert the refrigerant flowing through the refrigerant pipe 2*d*. In the present embodiment, the distal end of the discharge nozzle 28*a* is inserted so as to pass through the top of the frame 26*b* of the electric component assembly 26, and the nozzle opens into the electric component assembly 26. The distal end of the discharge nozzle 28*a* is also disposed above the control board 26*a* and other electric components in the present embodiment. The discharge valve 28*b* is a valve that is opened when the refrigerant is emitted from the refrigerant circuit 10 to the electric component assembly 26, and is composed of an electromagnetic valve in the present embodiment. Also connected to the discharge nozzle 28*a* is an oil filter 28*c* as an oil separation means that can separate refrigerator oil from the refrigerant when the refrigerant is emitted from the refrigerant circuit 10 to the electric component assembly 26. The oil filter 28*c* is connected at the upstream side of the discharge valve 28*b* in the present embodiment. Furthermore, connected to the discharge nozzle 28*a* is a capillary tube 28*d* for ensuring that the flow rate of the refrigerant emitted from the discharge nozzle 28*a* does not become excessive when the refrigerant is emitted from the refrigerant circuit 10 to the electric component assembly 26. The capillary tube 28*d* is connected at the upstream side of the discharge valve 28*b* and at the downstream side of the oil filter 28*c* in the present embodiment. The capillary tube 28*d* does not need to be connected to the discharge nozzle 28*a* in cases in which the flow resistance in the discharge nozzle 28*a*, the discharge valve 28*b*, and the oil filter 28*c* is alone sufficient to limit the flow rate of the refrigerant emitted from the discharge nozzle 28*a*. The positions where the oil filter 28*c* and the capillary tube 28*d* are connected are not limited to the connecting positions of the present embodiment, and various other connecting positions can be selected.

As described above, an air flow channel is formed in the outdoor unit 2 to extend to the discharge port 2*f* of the casing 2*a* through the intake ports 2*e* of the casing 2*a*, the outdoor heat exchanger 22, and the outdoor fan 25. The blowing fan 25 is rotatably driven, whereby outdoor air is taken in and heat is exchanged in the outdoor heat exchanger 22, and the air can then be blown upward out of the room. Since the refrigerant emission pipe 28 is provided in the outdoor unit 2, opening the discharge valve 28*b* of the refrigerant emission pipe 28, when the electric component assembly 26 ignites, allows the carbon dioxide as the refrigerant to be emitted from the refrigerant circuit 10 to the electric component assembly 26 to extinguish or cool the fire.

(Refrigerant Communication Pipe)

The refrigerant communication pipes 6, 7 are refrigerant pipes that are constructed on-site when installed at the location where the air conditioning apparatus 1 is installed.

As described above, the indoor-side refrigerant circuits 10*b*, 10*c*, the outdoor-side refrigerant circuit 10*a*, and the refrigerant communication pipes 6, 7 are connected, constituting the refrigerant circuit 10 of the air conditioning apparatus 1. In the air conditioning apparatus 1 of the present embodiment, a control unit 8 as a control means for performing control on the various operations of the air conditioning apparatus 1 is configured by the indoor-side control units 47, 57 and the outdoor-side control unit 37. The control unit 8 is connected so as to be capable of receiving signals from the remote controllers 4*e*, 5*e* and sensor signals from the various sensors 26*c*, 29, 30, 46*c*, 56*c*, and is connected to be capable of controlling the various devices and valves 21, 25, 28*b*, 41, 45, 48*b*, 51, 55, 58*b* on the basis of these signals and other factors.

(2) Operation of Air Conditioning Apparatus

Next, the operation of the air conditioning apparatus 1 of the present embodiment will be described.

(Normal Operation)

First, the operation of the air conditioning apparatus 1 during the cooling operation or dehumidification operation (hereinafter referred to as the normal operation) will be described using FIGS. 1, 3, 5, and 7. Controls for the various structural devices during the normal operation are performed by the control unit 8 of the air conditioning apparatus 1, which functions as a normal control means.

When the shut-off valves 23, 24 are full open state and an operation command for the cooling operation or dehumidification operation is issued from the remote controllers 4*e*, 5*e*, the compressor drive motor 21*a* of the compressor 21, the fan drive motor 25*a* of the outdoor fan 25, and the fan drive motors 45*a*, 55*a* of the indoor fans 45, 55 are started up. The low-pressure refrigerant is then drawn into the compressor 21 and is compressed to a pressure exceeding the critical pressure to become a high-pressure refrigerant. The high-pressure refrigerant is sent through the refrigerant pipe 2*b* to the outdoor heat exchanger 22, and heat exchange with the outdoor air supplied by the outdoor fan 25 is performed in the outdoor heat exchanger 22 that functions as a cooler, whereby the refrigerant is cooled. The outdoor air is taken into the casing 2*a* of the outdoor unit 2 through the intake ports 2*e* of the casing 2*a* by the operation of the outdoor fan 25, and after undergoing heat exchange with the refrigerant and being heated when passing through the outdoor heat exchanger 22, the outdoor air is discharged upward and outdoors through the discharge port 2*f* of the casing 2*a*.

The high-pressure refrigerant cooled in the outdoor heat exchanger 22 is sent to the indoor units 4, 5 via the refrigerant pipe 2*b*, the shut-off valve 23, and the refrigerant communication pipe 6. The high-pressure refrigerant sent to the indoor units 4, 5 is sent to the indoor expansion valves 41, 51 and reduced in pressure by the indoor expansion valves 41, 51 to a pressure lower than the critical pressure (specifically, a pressure near the intake pressure of the compressor 21). After the refrigerant has reached a low-pressure gas-liquid two-phase state, the refrigerant is sent to the indoor heat exchangers 42, 52 via the refrigerant pipe 4*c*, the refrigerant undergoes heat exchange with the indoor air and evaporates in the indoor heat exchangers 42, 52 that function as evaporators, and a low-pressure refrigerant is obtained. The indoor air is taken into the casing bodies 43, 53 through the intake ports 44*a*, 54*a* of the face panels 4*b*, 5*b* by the operation of the blowing fans 45, 55, the air undergoes heat exchange with the refrigerant when passing through the indoor heat exchangers 42, 52 and is cooled and/or dehumidified, and the air then is blown downward into the room through the discharge ports 44*e*, 54*e* of the face panel 4*b*.

The low-pressure refrigerant evaporated in the indoor heat exchangers 42, 52 is sent to the outdoor unit 2 via the refrigerant pipe 4*d* and the refrigerant communication pipe 7, and is again taken into the compressor 21 via the shut-off valve 24 and the refrigerant pipe 2*d*.

The normal operation is performed by this refrigerant cycle operation of the refrigerant circuit 10 and the operations of the outdoor fan 25 and indoor fans 45, 55. During the normal operation described above, the high-pressure refrigerant flows through the portion of the refrigerant circuit 10 extending from the compressor 21 to the indoor expansion valves 41, 51 as expansion mechanisms via the outdoor heat exchanger 22 as a cooler, the shut-off valve 23, and the refrigerant communication pipe 6. This portion is therefore the high-pressure portion of the refrigerant circuit 10. Also during the normal operation described above, the low-pressure refrigerant flows through the portion of the refrigerant circuit 10 extending from the indoor expansion valves 41, 51 as expansion mechanisms to the compressor 21 via the indoor heat exchangers 42, 52 as evaporators, the refrigerant communication pipe 7, and the shut-off valve 24. This portion is therefore the low-pressure portion of the refrigerant circuit 10.

(Refrigerant Emission Operation)

When the normal operation described above is performed, abnormal temperature increases in the electric component assemblies 26, 46, 56 sometimes occur and fire breaks out, because of overheating in the electric components or some other such reason. To deal with this problem, the air conditioning apparatus 1 of the present embodiment is designed so that when the abnormal temperature increase occurs in the electric component assembly 26 of the outdoor unit 2, a refrigerant emission operation is performed in which the carbon dioxide as a refrigerant is emitted from the refrigerant circuit 10 through the refrigerant emission pipe 28 as a refrigerant emission means to the electric component assembly 26 and the fire is extinguished or cooled. When the abnormal temperature increases occur in the electric component assemblies 46, 56 of the indoor units 4, 5, refrigerant emission operations are performed in which the carbon dioxide as a refrigerant is emitted from the refrigerant circuit 10 through the refrigerant emission pipes 48, 58 as refrigerant emission means to the electric component assemblies 46, 56, and the fire is extinguished or cooled.

Figure 8:
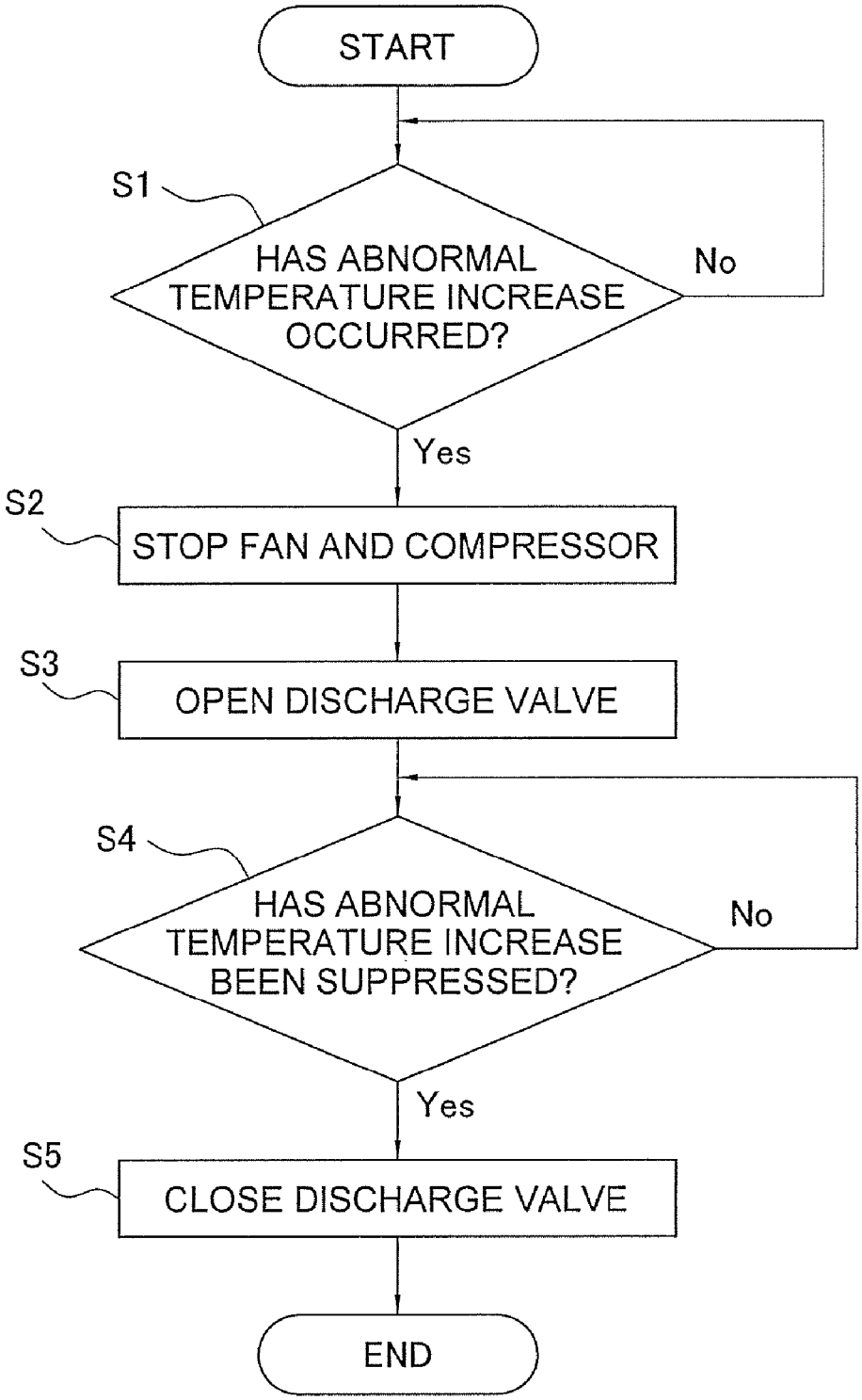
FIG. 8 is a flowchart of a refrigerant emission control according to embodiment 1.

The operation of the air conditioning apparatus 1 during the refrigerant emission operation will be described hereinbelow using FIGS. 1, 3, 4, 5, 7, and 8. Controls for the various structural devices during the refrigerant emission operation (hereinafter referred to as refrigerant emission control) are performed by the control unit 8 of the air conditioning apparatus 1, which functions as an emission control means. FIG. 8 is a flowchart of the refrigerant emission control in the present embodiment.

First is a description of refrigerant emission control in cases in which the abnormal temperature increase has occurred in the electric component assembly 26 of the outdoor unit 2.

First, in step S1 in FIG. 8, it is determined whether or not the abnormal temperature increase has occurred in the electric component assembly 26. To determine whether an abnormal temperature increase has occurred in the electric component assembly 26, it is preferable to make the determination on the basis of the quantity of state caused by the abnormal temperature increase in the electric component assembly 26, and a detection sensor for detecting such a quantity of state must be provided. In the present embodiment, the electric component temperature sensor 26*c* is used as such a detection sensor. In other words, in step S1, it is determined whether or not the abnormal temperature increase has occurred in the electric component assembly 26 on the basis of the temperature of the electric component assembly 26 as sensed by the electric component temperature sensor 26*c*. Specifically, assuming, for example, that the temperature of the electric component assembly 26 as sensed by the electric component temperature sensor 26*c* is higher than a specific temperature, it can be determined that the abnormal temperature increase has occurred in the electric component assembly 26.

Thus, in step S1, since it is determined whether or not the abnormal temperature increase has occurred in the electric component assembly 26 on the basis of the quantity of state caused by the abnormal temperature increase in the electric component assembly 26, it is possible to appropriately determine whether or not the electric component assembly 26 has ignited, and to take fire-extinguishing measures on the electric component assembly 26. Since the electric component temperature sensor 26*c* for sensing the temperature of the electric component assembly 26 is used as the detection sensor for sensing the quantity of state caused by the abnormal temperature increase in the electric component assembly 26, it is possible to accurately detect the occurrence of the abnormal temperature increase in the electric component assembly 26.

Next, when it is determined in step S1 that the abnormal temperature increase has occurred in the electric component assembly 26, a process is performed in step S2 to stop the outdoor fan 25 and the compressor 21. The purpose of stopping the outdoor fan 25 and the compressor 21 is to create, during the operation of the following step S3, a state in which it is difficult for air to be supplied to the electric component assembly 26, and a state in which heat generation in the electric component assembly 26 is severely inhibited. The process in step S2 is performed in order to promote the fire-extinguishing and cooling effects of the electric component assembly 26 in step S3 and is therefore preferably performed before step S3 as in the present embodiment, but may also be performed at the same time as step S3 or immediately after step S3 begins.

Next, in step S3, a control is performed in which the refrigerant emission pipe 28 as a refrigerant emission means is operated so that the carbon dioxide as a refrigerant is emitted from the refrigerant circuit 10 to the electric component assembly 26. Specifically, an operation is performed in which the discharge valve 28*b* of the refrigerant emission pipe 28 is opened, thereby emits the carbon dioxide as a refrigerant from the refrigerant circuit 10 to the electric component assembly 26. A fire can thereby be extinguished by the carbon dioxide when the electric component assembly 26 ignites due to the abnormal temperature increase. Moreover, the electric component assembly 26 can be cooled because the carbon dioxide at a pressure higher than atmospheric pressure is filled within the refrigerant circuit 10 and the carbon dioxide is reduced in pressure to atmospheric pressure and brought to a relatively low temperature when the carbon dioxide is emitted to the electric component assembly 26.

In the present embodiment, since the distal end of the discharge nozzle 28*a* of the refrigerant emission pipe 28 is disposed above the electric component assembly 26, the difference in density between the carbon dioxide and the air can be used to emit the carbon dioxide from the refrigerant circuit 10 so as to sprinkle the carbon dioxide on the control board 26*a* and the other electric components, and a carbon dioxide atmosphere can be quickly created for the electric component assembly 26 and its periphery. In the present embodiment, since the distal end of the discharge nozzle 28*a* of the refrigerant emission pipe 28 opens into the electric component assembly 26 (specifically, into the frame 26*b* of the electric component assembly 26), the carbon dioxide can be blown directly onto electric components that are susceptible to the abnormal temperature increase, and fire extinguishing and cooling for the electric component assembly 26 can be effectively performed.

In the present embodiment, since the oil filter 28*c* as an oil separation means is connected to the discharge nozzle 28*a* of the refrigerant emission pipe 28, the carbon dioxide can be emitted from the refrigerant circuit 10 to the electric component assembly 26 without emitting as much refrigerator oil as possible, and the effects of fire extinguishing by the carbon dioxide are not hindered even in cases in which a flammable substance is used as a refrigerator oil.

In the present embodiment, since the refrigerant emission pipe 28 is connected to the refrigerant pipe 2*d* on the intake side of the compressor 21 as the low-pressure portion of the refrigerant circuit 10 through which the low-pressure refrigerant flows during the normal operation, the carbon dioxide can be emitted continuously over a long period of time.

Next, in step S4, after the operation of emitting carbon dioxide from the refrigerant circuit 10 to the electric component assembly 26 in step S3 has begun, it is determined, based on the quantity of state (specifically, the temperature of the electric component assembly 26) detected by the electric component temperature sensor 26*c* as the detection sensor, whether the abnormal temperature increase in the electric component assembly 26 has been suppressed. Specifically, it can be determined that the abnormal temperature increase in the electric component assembly 26 has been suppressed, given, for example, that the temperature of the electric component assembly 26 as detected by the electric component temperature sensor 26*c* is equal to or less than a specific temperature. For the specific temperature for performing the determination of whether or not the abnormal temperature increase in the electric component assembly 26 has been suppressed, it is possible to use either the same value as the specific temperature for determining whether or not the abnormal temperature increase has occurred in the electric component assembly 26 in step S1 described above, or a value less than this value.

When it is determined that the abnormal temperature increase in the electric component assembly 26 has not been suppressed, the process in steps S3 and S4 are performed continuously, and when it is determined that the abnormal temperature increase in the electric component assembly 26 has been suppressed, the process advances to step S5, the discharge valve 28*b* is closed, and the refrigerant emission control is ended.

Thus, in steps S4 and S5, after it is determined that an abnormal temperature increase has occurred in the electric component assembly 26 (step S1) and the emission of the carbon dioxide from the refrigerant circuit 10 is initiated (step S3), the decision is made as to whether or not the abnormal temperature increase in the electric component assembly 26 has been suppressed. When it is determined that the abnormal temperature increase in the electric component assembly 26 has been suppressed, the emission of the carbon dioxide is ended, and fire extinguishing and cooling for the electric component assembly 26 can therefore be reliably performed.

The following is a description of the refrigerant emission control for cases in which the abnormal temperature increases have occurred in the electric component assemblies 46, 56 of the indoor units 4, 5. The refrigerant emission control for the electric component assemblies 46, 56 of the indoor units 4, 5 are similar to the refrigerant emission control for the electric component assembly 26 of the outdoor unit 2. Therefore, in the description using FIG. 8 of the refrigerant emission control for the electric component assembly 26 of the outdoor unit 2, reference numerals in the 20s indicating the components of the outdoor unit 2 are replaced by reference numerals in the 40s indicating the components of the indoor unit 4 and by reference numerals in the 50s indicating the components of the indoor unit 5, whereby the descriptions are omitted. In step S2 in the refrigerant emission control for the electric component assembly 46 of the indoor unit 4, the outdoor fan 25 and the compressor 21 are not stopped as in step S2 in the refrigerant emission control for the electric component assembly 26 of the outdoor unit 2, but instead a process is performed for stopping the indoor fan 45 and the compressor 21; and in step S2 in the refrigerant emission control for the electric component assembly 56 of the indoor unit 5, a process is performed for stopping the indoor fan 55 and the compressor 21. In the refrigerant emission pipe 48 of the electric component assembly 46 of the indoor unit 4 and in the refrigerant emission pipe 58 of the electric component assembly 56 of the indoor unit 5, as with the refrigerant emission pipe 28 of the electric component assembly 26 of the outdoor unit 2, the carbon dioxide can be emitted from the low-pressure portion of the refrigerant circuit 10 through which the low-pressure refrigerant flows during the normal operation. However, the specific connected positions of the refrigerant emission pipes differ in that the refrigerant emission pipe 48 in the indoor unit 4 is connected either to the refrigerant pipe 4*d* (see FIG. 1) on the outlet side of the indoor heat exchanger 42 that functions as an evaporator, or to the refrigerant pipe 4*c* (see FIG. 5) between the indoor expansion valve 41 and the indoor heat exchanger 42; and the refrigerant emission pipe 58 in the indoor unit 5 is connected either to the refrigerant pipe 5*d* (see FIG. 1) on the outlet side of the indoor heat exchanger 52 that functions as an evaporator, or to the refrigerant pipe 5*c* (see FIG. 5) between the indoor expansion valve 51 and the indoor heat exchanger 52.

As described above, the air conditioning apparatus 1 of the present embodiment is a so-called separated air conditioning apparatus configured by connecting the outdoor unit 2 and the indoor units 4, 5 via the refrigerant communication pipes 6, 7, wherein the units 2, 4, 5 have the electric component assemblies 26, 46, 56. In the present embodiment, in view of the occurrences of the abnormal temperature increases in the electric component assemblies 26, 46, 56, the refrigerant emission pipes 28, 48, 58 as refrigerant emission means are provided to the outdoor unit 2 and to both the indoor units 4, 5. When the abnormal temperature increase has occurred in the electric component assembly 26 of the outdoor unit 2, the refrigerant emission operation can be performed in which the carbon dioxide as a refrigerant is emitted from the refrigerant circuit 10 through the refrigerant emission pipe 28 to the electric component assembly 26 to extinguish fire or to cool, and when the abnormal temperature increase has occurred in the electric component assembly 46 or 56 of the indoor unit 4 or 5, the refrigerant emission operation can be performed in which the carbon dioxide as a refrigerant is emitted from the refrigerant circuit 10 through the refrigerant emission pipe 48 or 58 to the electric component assembly 46 or 56 to extinguish fire or to cool. However, another option is to provide a refrigerant emission pipe 28 as a refrigerant emission means to only the outdoor unit 2 for cases in which only the abnormal temperature increase in the electric component assembly 26 of the outdoor unit 2 is a concern, or to provide a refrigerant emission pipes as refrigerant emission means 48, 58 to only the indoor units 4, 5 for cases in which only the abnormal temperature increases in the electric component assemblies 46, 56 of the indoor units 4, 5 are a concern.

(3) Modification 1

Figure 9:
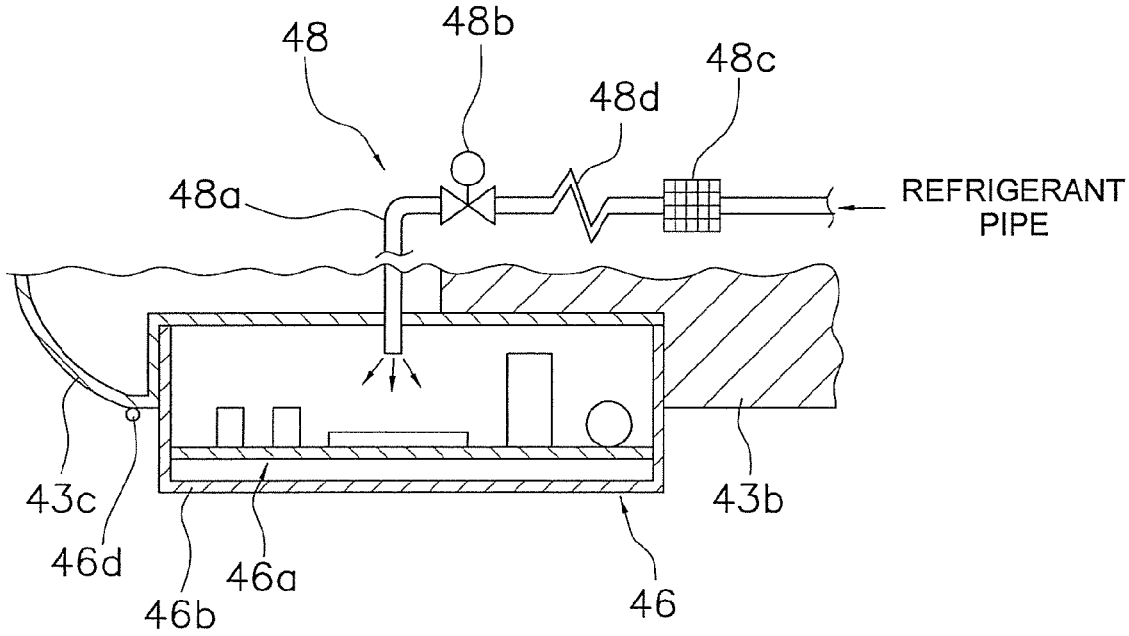
FIG. 9 is a drawing equivalent to FIG. 4, showing the schematic configuration of a refrigerant emission pipe and an electric component assembly according to Modification 1 of Embodiment 1.

In the embodiment described above, the electric component temperature sensors 26*c*, 46*c*, 56*c* for sensing the temperatures of the electric component assemblies 26, 46, 56 are used as the detection sensors used in the determination of whether or not the abnormal temperature increases have occurred in the electric component assemblies 26, 46, 56 during refrigerant emission control, but these types of electric component assemblies 26, 46, 56 do not need to be provided with specialized temperature sensors. Instead of providing electric component temperature sensors 26*c*, 46*c*, 56*c* for sensing the temperatures of the electric component assemblies 26, 46, 56, other temperature sensors may be substituted, such as, e.g., rather than providing the indoor unit 4 with the electric component temperature sensor 46*c*, an intake temperature sensor 46*d* for sensing the temperature of indoor air taken in through the intake port 44*a* may be provided in proximity to the electric component assembly 46 (the portion of the bell mouth 43*c* near the electric component assembly 46 in this case) as shown in FIG. 9, thereby the intake temperature sensor 46*d* can be substituted as the detection sensor used in the determination of whether or not the abnormal temperature increase has occurred in the electric component assemblies 26, 46, 56 (with the indoor unit 5, an intake temperature sensor 56*d* is similarly substituted in place of the electric component temperature sensor 56*c*).

For the detection sensors used in the determination of whether or not the abnormal temperature increases have occurred in the electric component assemblies 26, 46, 56 during refrigerant emission control, a gas sensor for sensing the concentration of gas (e.g., oxygen) that changes along with fire ignition in the electric component assemblies 26, 46, 56, a smoke sensor for detecting the amount of smoke that has occurred along with fire ignition in the electric component assemblies 26, 46, 56, or other such sensors may be used instead of the temperature sensor, as long as they can sense a change in the quantity of state resulting from the abnormal temperature increases in the electric component assemblies 26, 46, 56.

(4) Modification 2

In the embodiment and Modification 1 described above, the operation is performed in step S3 (see FIG. 8) of the refrigerant emission control in which the carbon dioxide is emitted from the refrigerant circuit 10 to the electric component assemblies 26, 46, 56 by opening the discharge valves 28*b*, 48*b*, 58*b*. The term "open" used herein refers to keeping the discharge valves 28*b*, 48*b*, 58*b* composed of electromagnetic valves in a state of being fully open (this state is hereinafter referred to as the full open state), but when the discharge valves 28*b*, 48*b*, 58*b* are in the full open state in this manner, depending on the case, there are sometimes cases in which the flow rate of refrigerant emitted from the discharge nozzles 28*a*, 48*a*, 58*a* cannot be sufficiently limited by only the flow resistance in the discharge nozzles 28*a*, 48*a*, 58*a*, the discharge valves 28*b*, 48*b*, 58*b*, the oil filters 28*c*, 48*c*, 58*c*, and the capillary tubes 28*d*, 48*d*, 58*d*. In view of this, in the present modification, the carbon dioxide is intermittently emitted from the refrigerant circuit 10 (this state is hereinafter referred to as the intermittently open state) by repeating the operations of opening and closing the discharge valves 28*b*, 48*b*, 58*b* in step S3 of the refrigerant emission control. This thereby makes it possible to perform the refrigerant emission control in which the carbon dioxide is emitted from the refrigerant circuit 10 to the electric component assemblies 26, 46, 56 while limiting the carbon dioxide so that a large amount is not emitted in a short amount of time.

In the opening and closing operations of the discharge valves 28*b*, 48*b*, 58*b*, the refrigerant emission control can be performed while the flow rate of the carbon dioxide emitted from the refrigerant circuit 10 is adjusted by varying the ratio of the time in the full open state to the time in the full close state. More specifically, the flow rate of the carbon dioxide emitted from the refrigerant circuit 10 can be adjusted by creating a state in which the time during which the discharge valves 28*b*, 48*b*, 58*b* are full open is t1, and the time during which the discharge valves 28*b*, 48*b*, 58*b* are full close is t2 (hereinafter referred to as a first emission state), as shown in FIG. 10(*a*); and a state in which the flow rate of the carbon dioxide emitted is greater than in the first emission state, wherein the time during which the discharge valves 28*b*, 48*b*, 58*b* are full open is t1', which is greater than t1, and the time during which the discharge valves 28*b*, 48*b*, 58*b* are full close is t2', which is less than t2 (hereinafter referred to as a second emission state), as shown in FIG. 10(*b*).

Figure 11:
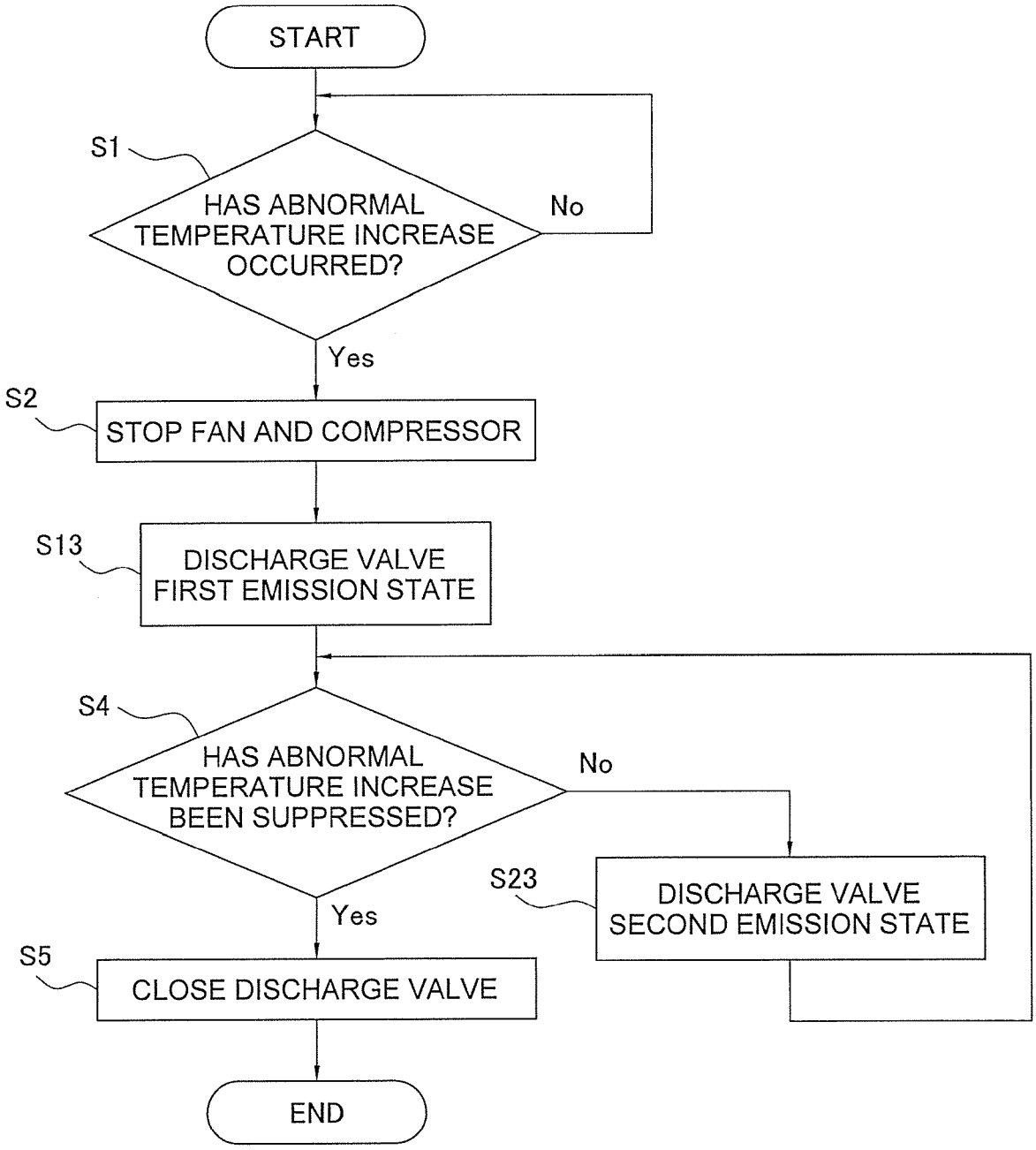
FIG. 11 is a flowchart of a refrigerant emission control according to Modification 2 of Embodiment 1.

A refrigerant emission control such as is shown in FIG. 11 can be performed using the intermittently open states of the discharge valves 28*b*, 48*b*, 58*b*. Steps S1, S2, S4, and S5 in the refrigerant emission control of the present modification are the same as steps S1, S2, S4, and S5 in the refrigerant emission control of the embodiment and Modification 1 described above. Therefore, steps S13 and S23 will be described mainly, using the refrigerant emission control for the electric component assembly 26 of the outdoor unit 2 as an example.

Figure 10A:
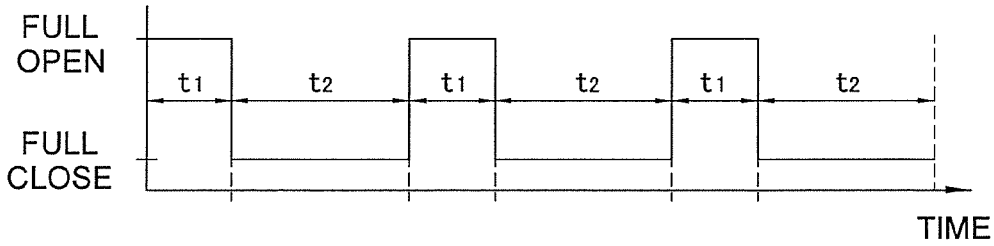
FIGS. 10(*a*) and 10(*b*) are time charts showing first and second emission states of a discharge valve according to Modification 2 of Embodiment 1.
Figure 10B:
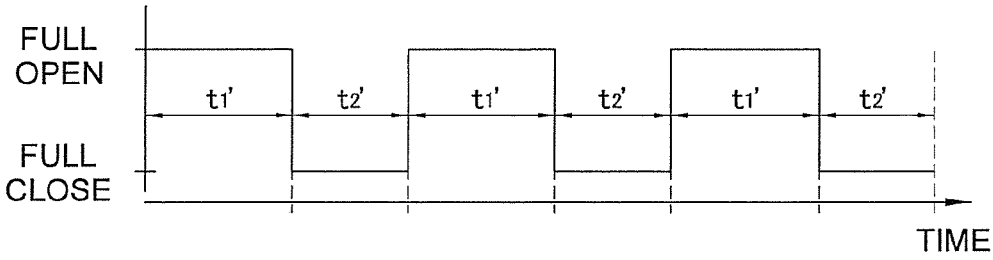

In step S13, a control is performed in which the discharge valve 28*b* is set to the first emission state (see FIG. 10(*a*)), and the refrigerant emission pipe 28 as a refrigerant emission means is operated so that the carbon dioxide as a refrigerant is emitted from the refrigerant circuit 10 to the electric component assembly 26.

Next, in step S4, after the operation of emitting the carbon dioxide from the refrigerant circuit 10 to the electric component assembly 26 has been initiated in step S13, the quantity of state sensed by a detection sensor (e.g., the electric component temperature sensor 26*c*) is used as a basis to determine whether or not the abnormal temperature increase in the electric component assembly 26 has been suppressed. When it is determined that the abnormal temperature increase in the electric component assembly 26 has not been suppressed, the process advances to step S23.

Next, in step S23, a control is performed in which the discharge valve 28*b* is set to the second emission state (see FIG. 10(*b*)) for emitting a greater flow rate of the carbon dioxide than the first emission state, and the refrigerant emission pipe 28 as the refrigerant emission means is operated so that the carbon dioxide as a refrigerant is emitted from the refrigerant circuit 10 to the electric component assembly 26.

Since the amount of the carbon dioxide emitted from the refrigerant circuit 10 to the electric component assembly 26 is then greater than in the first emission state, it is determined in the next step S4 that the abnormal temperature increase in the electric component assembly 26 has been suppressed, the process advances to step S5, and the discharge valve 28*b* is closed, ending the refrigerant emission control.

Thus, in the present modification, it is determined that the abnormal temperature increase has occurred (step S1) in the electric component assembly 26 (this also applies to the electric component assemblies 46, 56), and after the emission of the carbon dioxide from the refrigerant circuit 10 has begun (step S13), the decision is made as to whether or not the abnormal temperature increase in the electric component assembly 26 has been suppressed (step S4). A control is performed so that the amount of the carbon dioxide emitted increases when it is determined that the abnormal temperature increase in the electric component assembly 26 has not been suppressed (step S23), and it is therefore possible to emit the carbon dioxide in an amount suitable for extinguishing fire or cooling the electric component assembly 26 while confirming the effects of suppressing the abnormal temperature increase in the electric component assembly 26.

In the present modification, the flow rate of the carbon dioxide emitted is increased in two stages including the first emission state and the second emission state. However, in cases in which, e.g., the process returns to step S4 from step S23, a process for switching the second emission state of the discharge valve 28*b* (this also applies to the discharge valves 48*b*, 58*b*) to the first emission state, and it is again determined in step S4 that the abnormal temperature increase in the electric component assembly 26 has not been suppressed; yet another possibility is to create a state in which the time during which the discharge valve 28*b* is full open is t1", which is greater than t1', and the time during which the discharge valve 28*b* is full close is t2", which is less than t2', making the flow rate of the carbon dioxide emitted greater than in the first emission state; thereby gradually increasing the flow rate of the emitted carbon dioxide by increasing the flow rate of the carbon dioxide emitted from the refrigerant circuit 10 or by another such tactic.

(5) Modification 3

Figure 12:
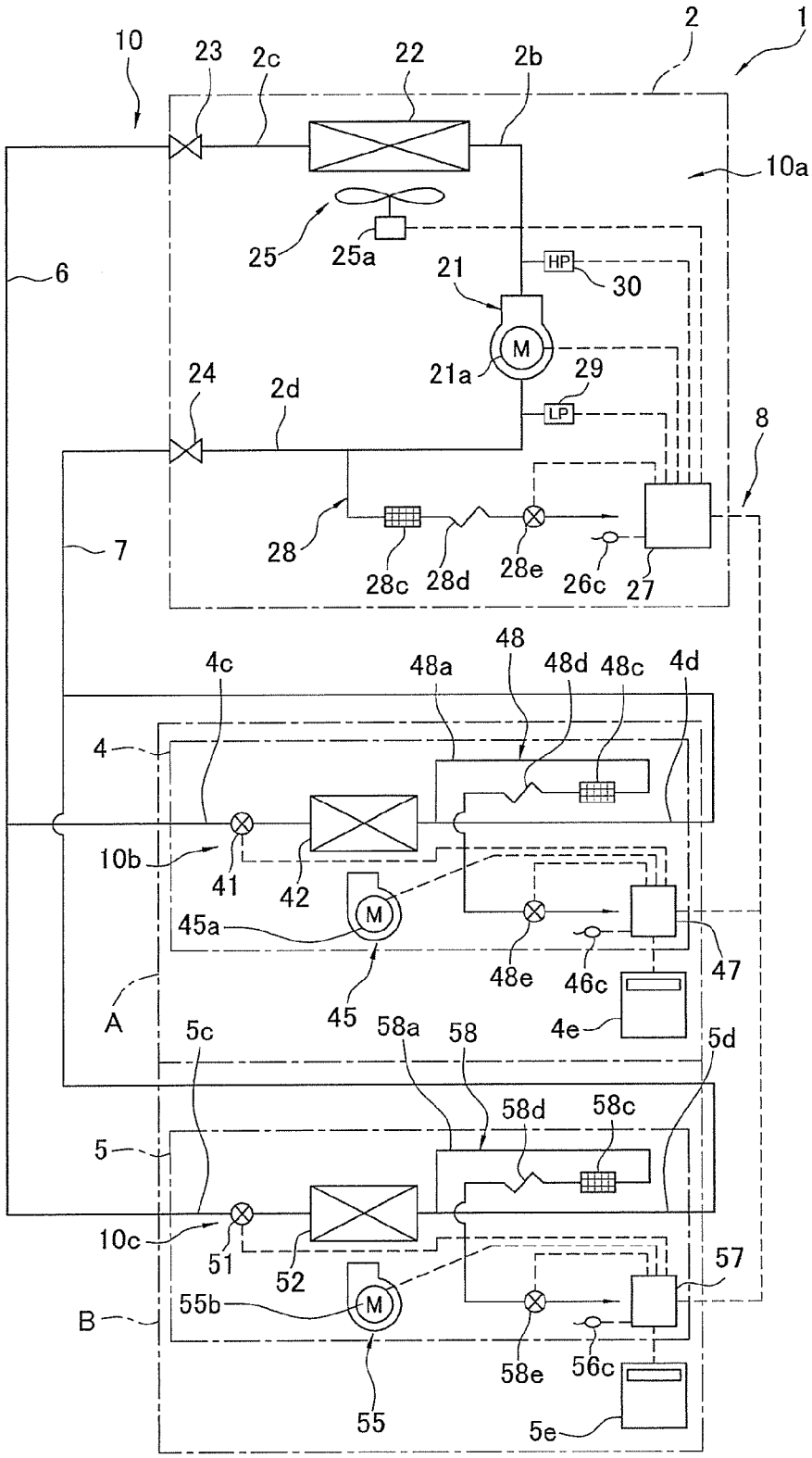
FIG. 12 is a schematic structural drawing of an air conditioning apparatus according to Modification 3 of Embodiment 1.

In Modification 2 described above, electromagnetic valves that could not be adjusted to intermediate positions between the full close and full open states were used as the discharge valves 28*b*, 48*b*, 58*b* as shown in FIGS. 1, 5, 6, 7, and 9. Another possibility is, e.g., to use discharge valves 28*e*, 48*e*, 58*e* that can be adjusted to intermediate positions, such as electrical expansion valves, as shown in FIG. 12. A refrigerant emission control in which the carbon dioxide is emitted from the refrigerant circuit 10 to the electric component assemblies 26, 46, 56 can thereby be performed while limiting the carbon dioxide so that a large amount is not emitted in a short amount of time.

If these discharge valves 28*e*, 48*e*, 58*e* are used, a refrigerant emission control such as is shown in FIG. 11 can be performed. Specifically, in steps S13 and 23 in Modification 2, the flow rate of the carbon dioxide emitted from the refrigerant circuit 10 can be adjusted by, e.g., setting the first emission state to a certain first open position and the second emission state to a second open position that is greater than the first open position. Therefore, as with the refrigerant emission control in Modification 2, it is possible to perform a refrigerant emission control in which the carbon dioxide is emitted in an amount suitable for extinguishing fire or cooling the electric component assemblies 26, 46, 56, while confirming the effects of suppressing the abnormal temperature increase in the electric component assemblies 26, 46, 56.

(6) Modification 4

Figure 13:
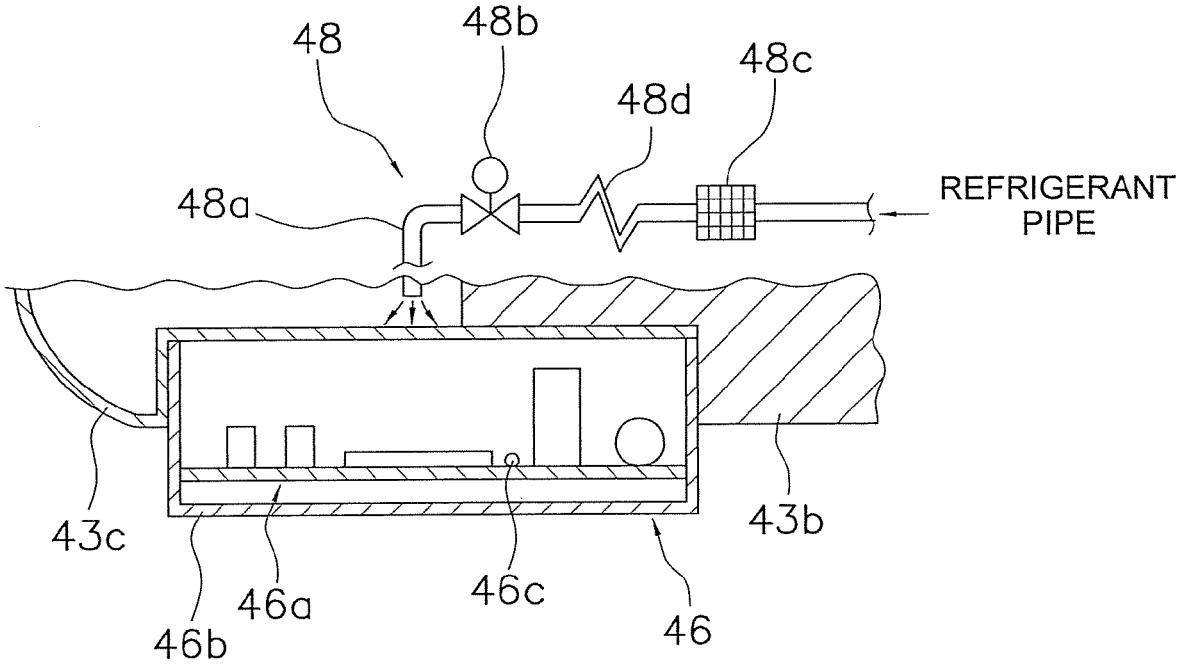
FIG. 13 is a drawing equivalent to FIG. 4, showing the schematic configuration of a refrigerant emission pipe and an electric component assembly according to Modification 4 of Embodiment 1.
Figure 14:
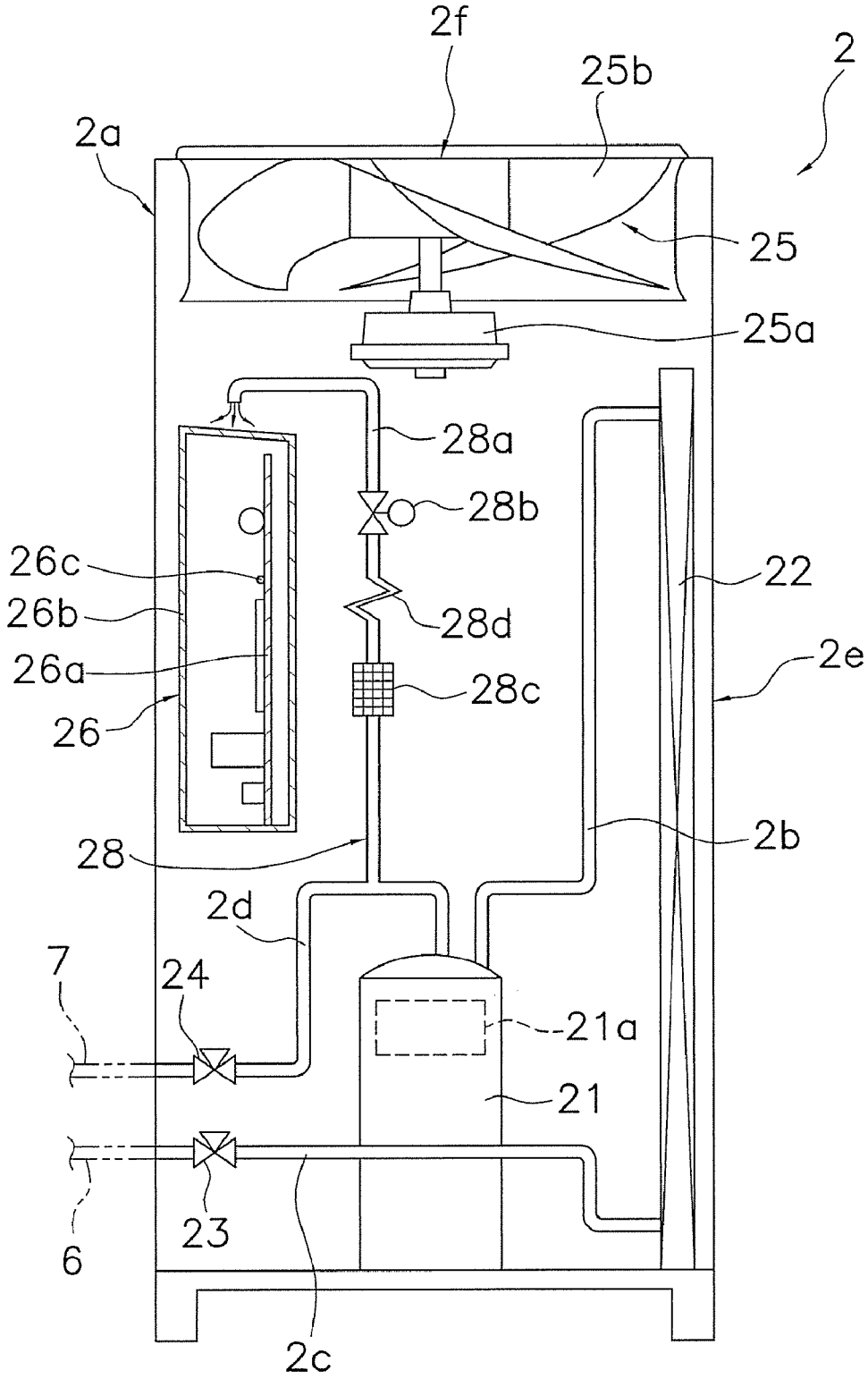
FIG. 14 is a drawing equivalent to FIG. 7, and is a schematic cross-sectional side view of an outdoor unit according to Modification 4 of Embodiment 1.

In the embodiment described above and in Modifications 1 through 3, the discharge nozzles 28*a*, 48*a*, 58*a* of the refrigerant emission pipes 28, 48, 58 open into the electric component assemblies 26, 46, 56 (more specifically, the distal ends of the discharge nozzles 28*a*, 48*a*, 58*a* are inserted into the frames 26*b*, 46*b*, 56*b*), as shown in FIGS. 3, 4, and 7, but another possibility is to dispose the distal ends of the discharge nozzles 28*a*, 48*a*, 58*a* so as to open above the frames 26*b*, 46*b*, 56*b* as shown in FIGS. 13 and 14, allowing the refrigerant to be sprinkled onto the electric component assemblies 26, 46, 56 from above. In this case, the carbon dioxide cannot be blown directly onto the electrical components likely to cause the abnormal temperature increases, in comparison with cases in which the distal ends of the discharge nozzles 28*a*, 48*a*, 58*a* are inserted into the frames 26*b*, 46*b*, 56*b*, but fire extinguishing and cooling can be performed for the electric component assemblies 26, 46, 56 because an atmosphere of carbon dioxide is created around the electric component assemblies 26, 46, 56 and their peripheries.

(7) Modification 5

In the embodiment and Modifications 1 through 4 described above, in the refrigerant emission control step S2, the process is performed for stopping the compressor 21 and the outdoor fan 25 for the electric component assembly 26 of the outdoor unit 2, and a process is performed for stopping the compressor 21 and the indoor fans 45, 55 for the electric component assemblies 46, 56 of the indoor units 4, 5 (see FIGS. 8 and 11). However, in another possibility, as shown in step S51 of FIG. 15, for example, after not stopping the compressor 21 during the refrigerant emission control for the electric component assembly 26 of the outdoor unit 2, but rather performing a process for stopping only the outdoor fan 25; and also after not stopping the compressor 21 during the refrigerant emission control for the electric component assemblies 46, 56 of the indoor units 4, 5 but rather performing a process for stopping only the indoor fans 45, 55, the processes in step S3 and the subsequent steps are performed.

It is thereby possible to perform fire extinguishing and cooling for the electric component assemblies 26, 46, 56 in a state in which air is not readily supplied to the electric component assemblies 26, 46, 56, and in a state in which the carbon dioxide flowing through the refrigerant circuit 10 is kept at an extremely high pressure and the emitted amount can be increased.

Figure 15:
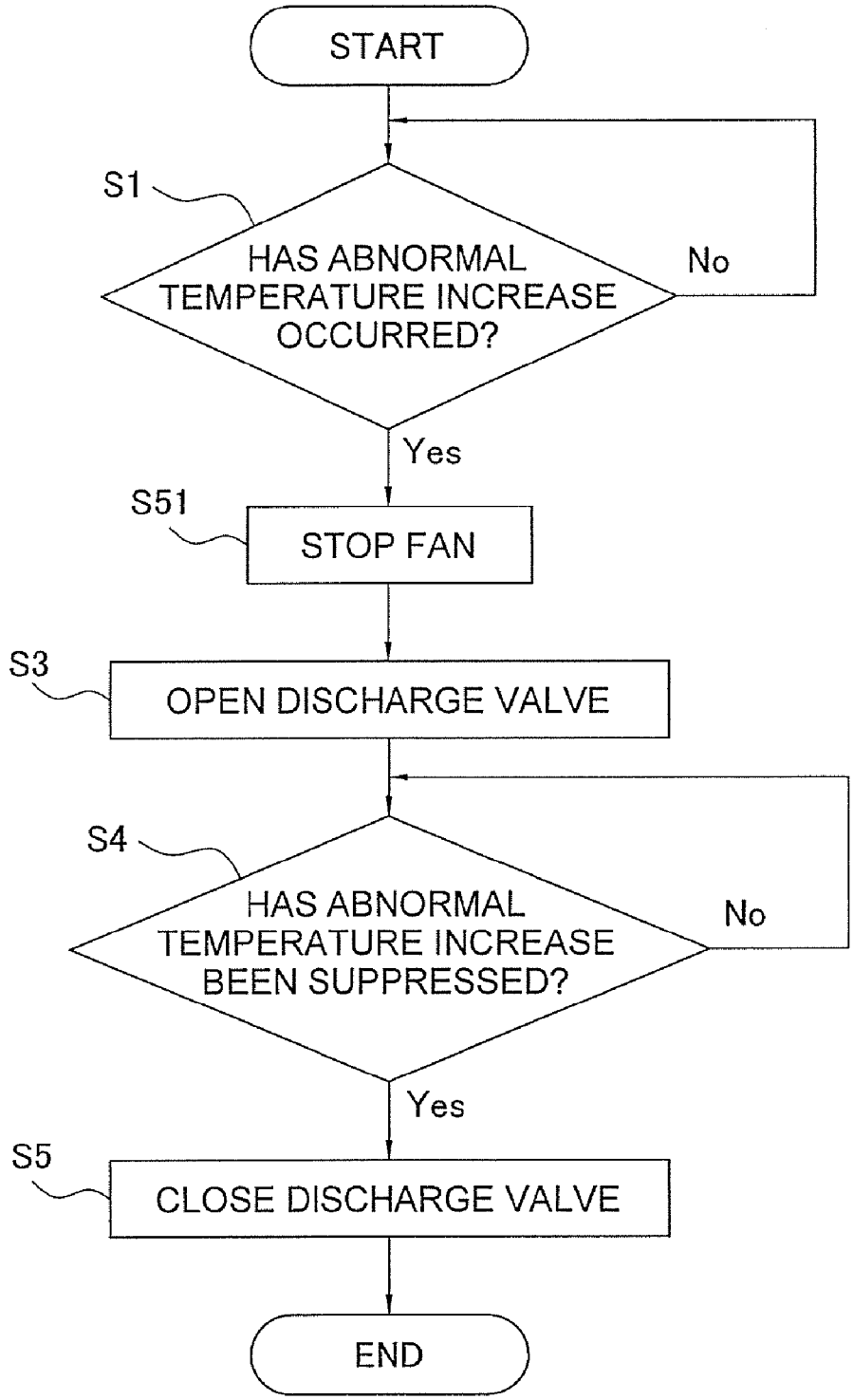
FIG. 15 is a flowchart of a refrigerant emission control according to Modification 5 of Embodiment 1.

The refrigerant emission control shown in FIG. 15 corresponds to refrigerant emission control in which the amount of the carbon dioxide emitted from the refrigerant circuit 10 is not adjusted according to the effects of suppressing the abnormal temperature increase, but can also be applied to correspond to refrigerant emission control in which the amount of the carbon dioxide emitted from the refrigerant circuit 10 is adjusted according to the effects of suppressing the abnormal temperature increase.

(8) Modification 6

In the embodiment and Modifications 1 through 4 described above, the refrigerant emission pipes 28, 48, 58 are used to perform the refrigerant emission control when the abnormal temperature increase has occurred in the electric component assemblies 26, 46, 56, but the carbon dioxide can also be emitted from the refrigerant circuit 10 towards the fan drive motors 25*a*, 45*a*, 55*a* or the compressor 21 when the fans 25, 45, 55 have locked or the compressor 21 has locked, it is thereby possible to protect against overheating and the like when the fans 25, 45, 55 or the compressor 21 have locked.

Figure 16:
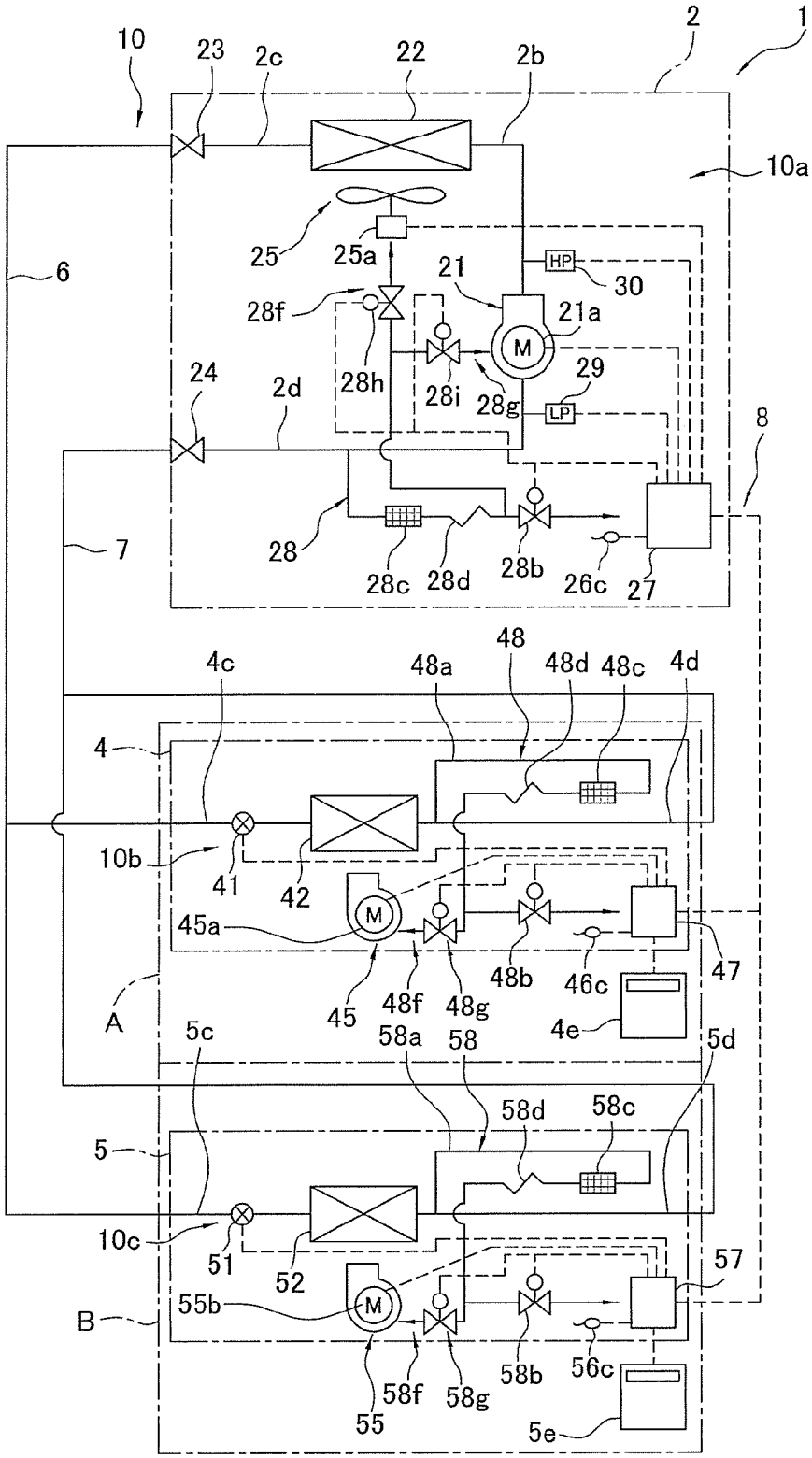
FIG. 16 is a schematic structural drawing of an air conditioning apparatus according to Modification 6 of Embodiment 1.

Another possibility for a configuration for emitting the carbon dioxide from the refrigerant circuit 10 towards the fan drive motors 25*a*, 45*a*, 55*a* or the compressor 21 when the fans 25, 45, 55 have locked or the compressor 21 has locked is one in which the outdoor unit 2 has, e.g., the refrigerant emission pipe 28 as a refrigerant emission means, in which the second and third discharge nozzles 28*f*, 28*g* branch off from positions upstream of the discharge valve 28*b* of the discharge nozzle 28*a*, and second and third discharge valves 28*h*, 28*i* are provided with the second and third discharge nozzles 28*f*, 28*g*, as shown in FIG. 16. Another possibility is for the indoor units 4, 5 to have, e.g., refrigerant emission pipes 48, 58 as refrigerant emission means, in which second discharge nozzles 48*f*, 58*f* branch off from positions upstream of the discharge valves 48*b*, 58*b* of the discharge nozzles 48*a*, 58*a*, and second discharge valves 48*g*, 58*g* are provided with the second discharge nozzles 48*f*, 58*f*, as shown in FIG. 16.

In the present modification, when the fans 25, 45, 55 lock or the compressor 21 locks, a refrigerant emission operation can be performed in which the carbon dioxide as a refrigerant is emitted from the refrigerant circuit 10 through the refrigerant emission pipes 28, 48, 58 as refrigerant emission means onto the fans 25, 45, 55 and the compressor 21 to cool the fans and compressor.

Figure 17:
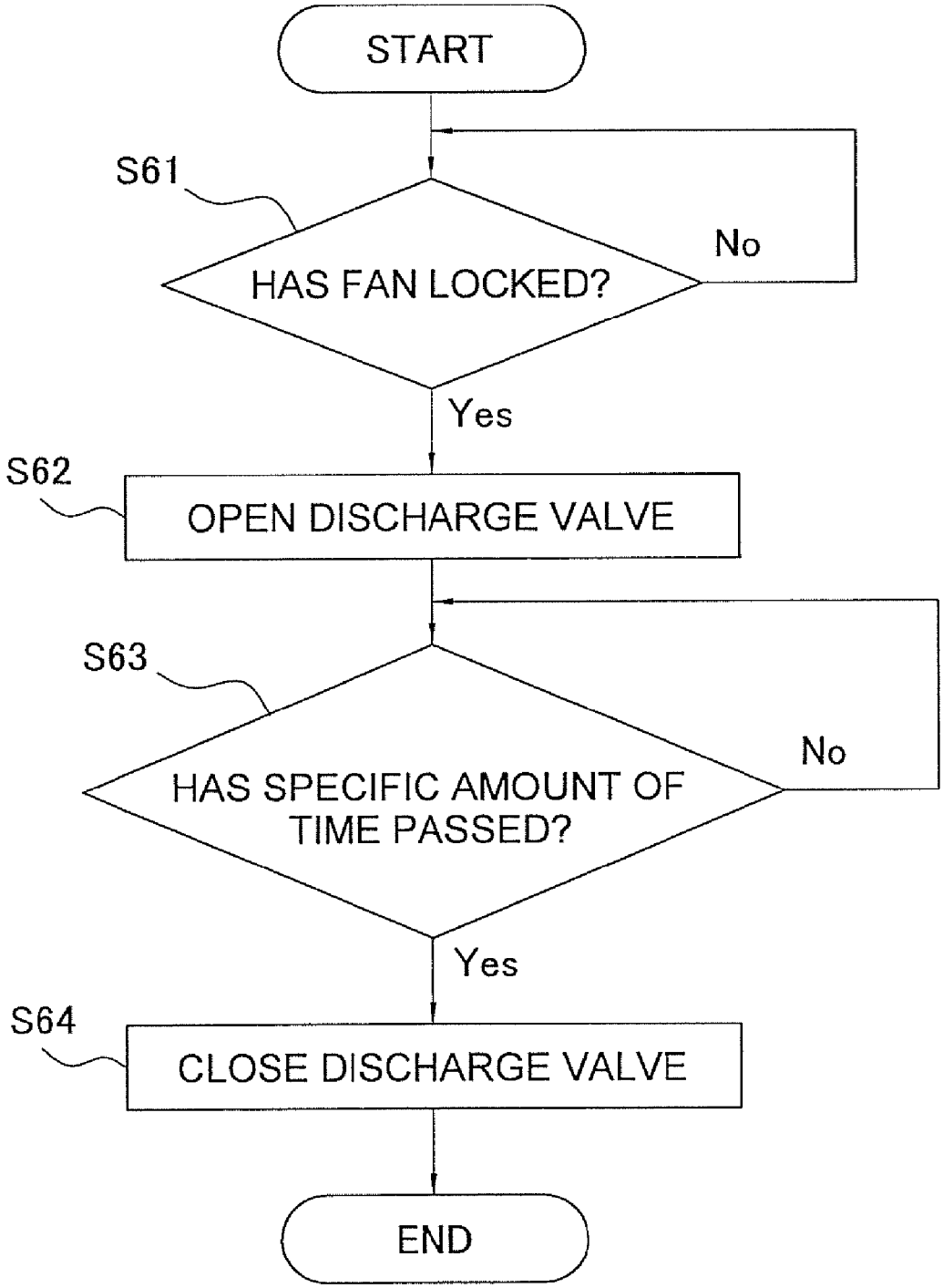
FIG. 17 is a flowchart of a refrigerant emission control during a fan lock according to Modification 6 of Embodiment 1.
Figure 18:
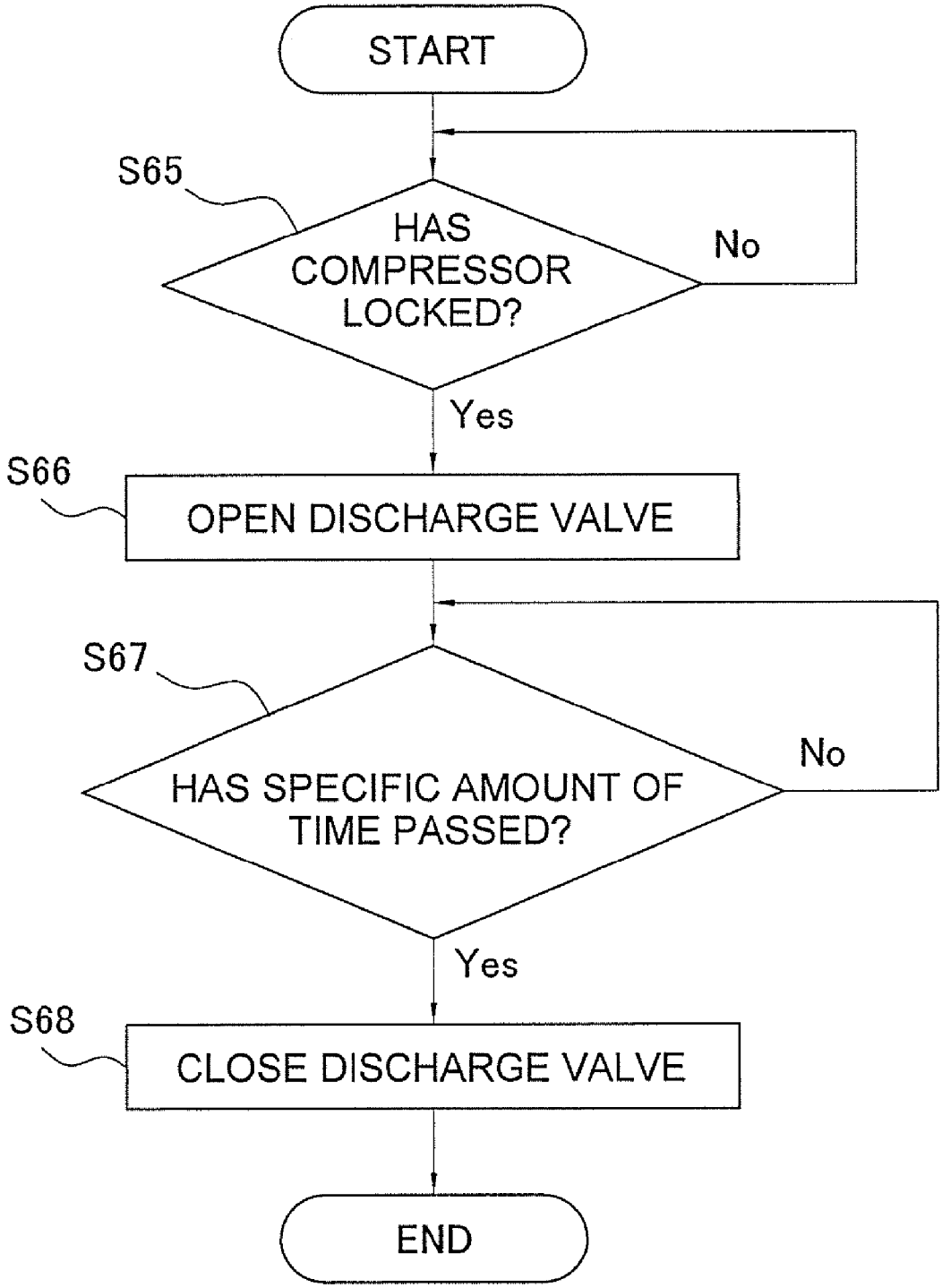
FIG. 18 is a flowchart of a refrigerant emission control during a compressor lock according to Modification 6 of Embodiment 1.

The following is a description using FIGS. 16 through 18 of the operation during the refrigerant emission operation when the fans 25, 45, 55 lock or the compressor 21 locks. Controls for the various structural devices during the refrigerant emission operation is herein performed by the control unit 8 of the air conditioning apparatus 1 that functions as a emission control means, similar to the refrigerant emission control in cases in which the abnormal temperature increases have occurred in the electric component assemblies 26, 46, 56. FIG. 17 is a flowchart of the refrigerant emission control during the fan lock in the present modification, and FIG. 18 is a flowchart of the refrigerant emission control during the compressor lock in the present modification.

First, the refrigerant emission control in a case in which the outdoor fan 25 of the outdoor unit 2 has locked will be described.

First, in step S61 in FIG. 17, it is determined whether or not the outdoor fan 25 has locked. Whether or not the outdoor fan 25 has locked is determined by whether the input current or rotational speed of the fan drive motor 25*a* is within a threshold range, or by another such factor.

Next, when it is determined in step S61 that the outdoor fan 25 has locked, a control is performed in which the refrigerant emission pipe 28 as a refrigerant emission means is operated so that the carbon dioxide as a refrigerant is emitted from the refrigerant circuit 10 to the fan drive motor 25*a* in step S62. Specifically, an operation is performed for emitting the carbon dioxide as a refrigerant from the refrigerant circuit 10 to the fan drive motor 25*a* by setting the discharge valve 28*h* of the refrigerant emission pipe 28 to the open state. It is thereby possible to protect against overheating and other such problems when the outdoor fan 25 has locked.

The process in step S62 is performed until it is determined that a specific amount of time has passed in step S63, and after it has been determined that the specific amount of time has passed in step S63, the process advances to step S64, the discharge valve 28*h* is closed, and the refrigerant emission control is ended.

The following is a description of the refrigerant emission control in a case in which the indoor fans 45, 55 of the indoor units 4, 5 have locked. Since the refrigerant emission control in a case in which the indoor fans 45, 55 of the indoor units 4, 5 have locked is the same as the refrigerant emission control in a case in which the outdoor fan 25 of the outdoor unit 2 has locked, in the description referencing FIG. 17 of the refrigerant emission control in a case in which the outdoor fan 25 of the outdoor unit 2 has locked, the numerical symbols in the 20s indicating the components of the outdoor unit 2 are either replaced by numerical symbols in the 40s indicating the components of the indoor unit 4 while the discharge valve 28*h* is replaced by the discharge valve 48*g*, or are replaced by numerical symbols in the 50s indicating components of the indoor unit 5 while the discharge valve 28*h* is replaced by the discharge valve 58*g*, and thereby the description can be omitted.

The following is a description of the refrigerant emission control in a case in which the compressor 21 of the outdoor unit 2 has locked.

First, in step S65 in FIG. 18, it is determined whether or not the compressor 21 has locked. Whether or not the compressor 21 has locked is determined by, e.g., whether the input current or rotational speed of the compressor drive motor 21*a* is within a threshold range, or by another such factor.

Next, when it is determined in step S65 that the compressor 21 has locked, a control is performed in step S66 which the refrigerant emission pipe 28 as a refrigerant emission means is operated so that the carbon dioxide as a refrigerant is emitted from the refrigerant circuit 10 to the compressor drive motor 21*a*. Specifically, an operation is performed for emitting carbon dioxide as a refrigerant from the refrigerant circuit 10 to the compressor 21 by setting the discharge valve 28*i* of the refrigerant emission pipe 28 to the open state. It is thereby possible to protect against overheating in the compressor 21 and other such problems when the compressor 21 has locked.

The process in step S66 is performed until it is determined that a specific amount of time has passed in step S67, and after it has been determined that the specific amount of time has passed in step S67, the process advances to step S68, the discharge valve 28*i* is closed, and the refrigerant emission control is ended.

As described above, in the present modification, in view of the occurrences of locking in the fans 25, 45, 55 and the compressor 21, the refrigerant emission operation can be performed in which the refrigerant emission pipes 28, 48, 58 as refrigerant emission means provided to the outdoor unit 2 and to both the indoor units 4, 5 are used and carbon dioxide as a refrigerant is emitted from the refrigerant circuit 10 through the refrigerant emission pipe 28 (more specifically, through the second discharge nozzle 28*f* and the second discharge valve 28*h*, or the third discharge nozzle 28*g* and the third discharge valve 28*i*) onto the fan drive motor 25*a* or the compressor 21 to protect against overheating and other such problems in cases in which the outdoor fan 25 or the compressor 21 has locked, and the carbon dioxide as a refrigerant is emitted from the refrigerant circuit 10 through the refrigerant emission pipes 48, 58 (more specifically, through the second discharge nozzle 48*f* and the second discharge valve 48*g*, or the second discharge nozzle 58*f* and the second discharge valve 58*g*) onto the fan drive motors 45*a*, 55*a* to protect against overheating and other such problems in cases in which the indoor fans 45, 55 have locked. However, in cases in which only the locking of the compressor 21 in the outdoor unit 2 is a concern, for example, the second discharge nozzle 28*f* and the second discharge valve 28*h* are not needed, and, conversely, in cases in which only the locking of the outdoor fan 25 is a concern, the third discharge nozzle 28*g* and the third discharge valve 28*i* are not needed. In cases in which the locking of the indoor fans 45, 55 are of no concern in the indoor units 4, 5, the second discharge nozzles 48*f*, 58*f* and the second discharge valves 48*g*, 58*g* are not needed.

(9) Modification 7

Figure 19:
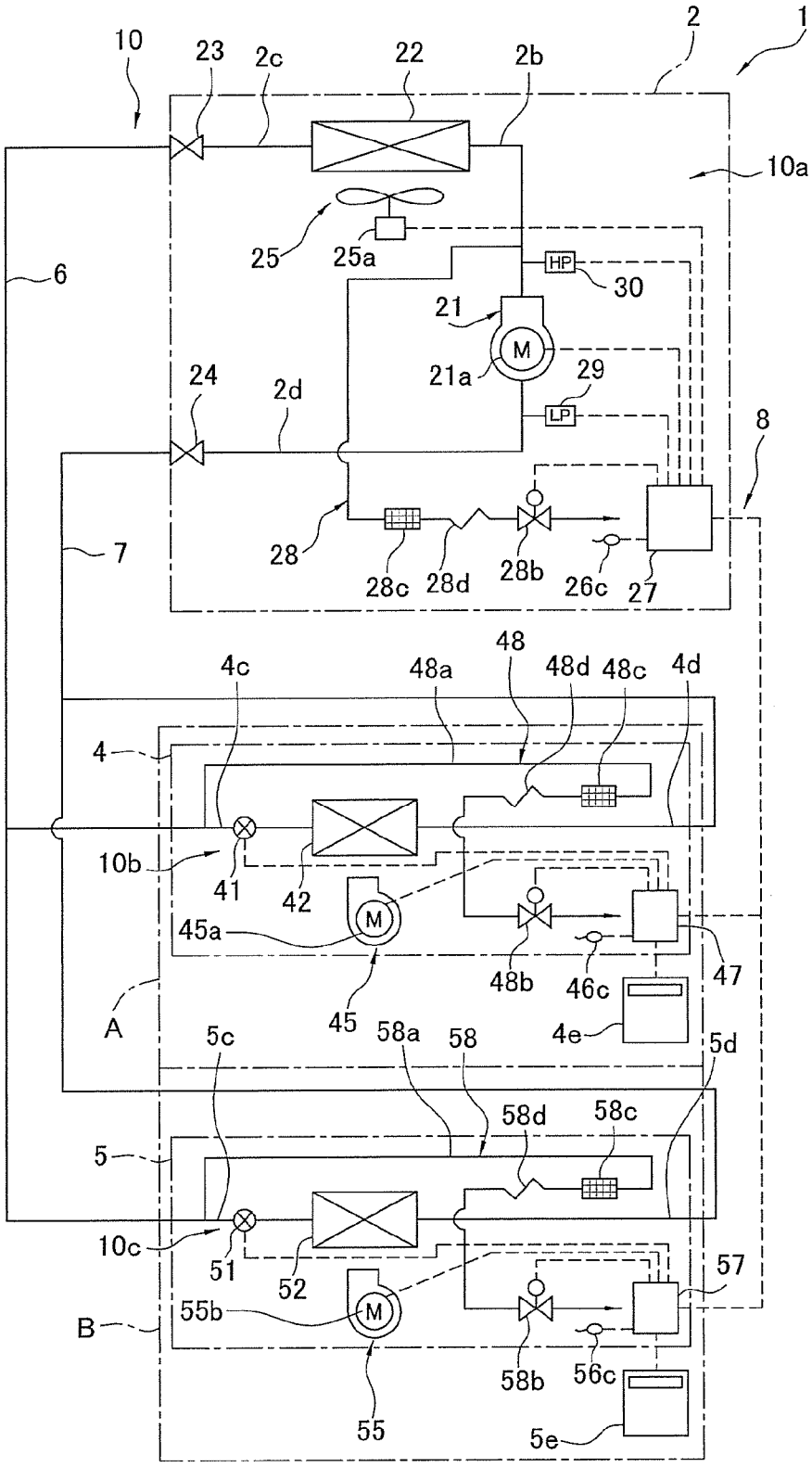
FIG. 19 is a schematic structural drawing of an air conditioning apparatus according to Modification 7 of Embodiment 1.
Figure 20:
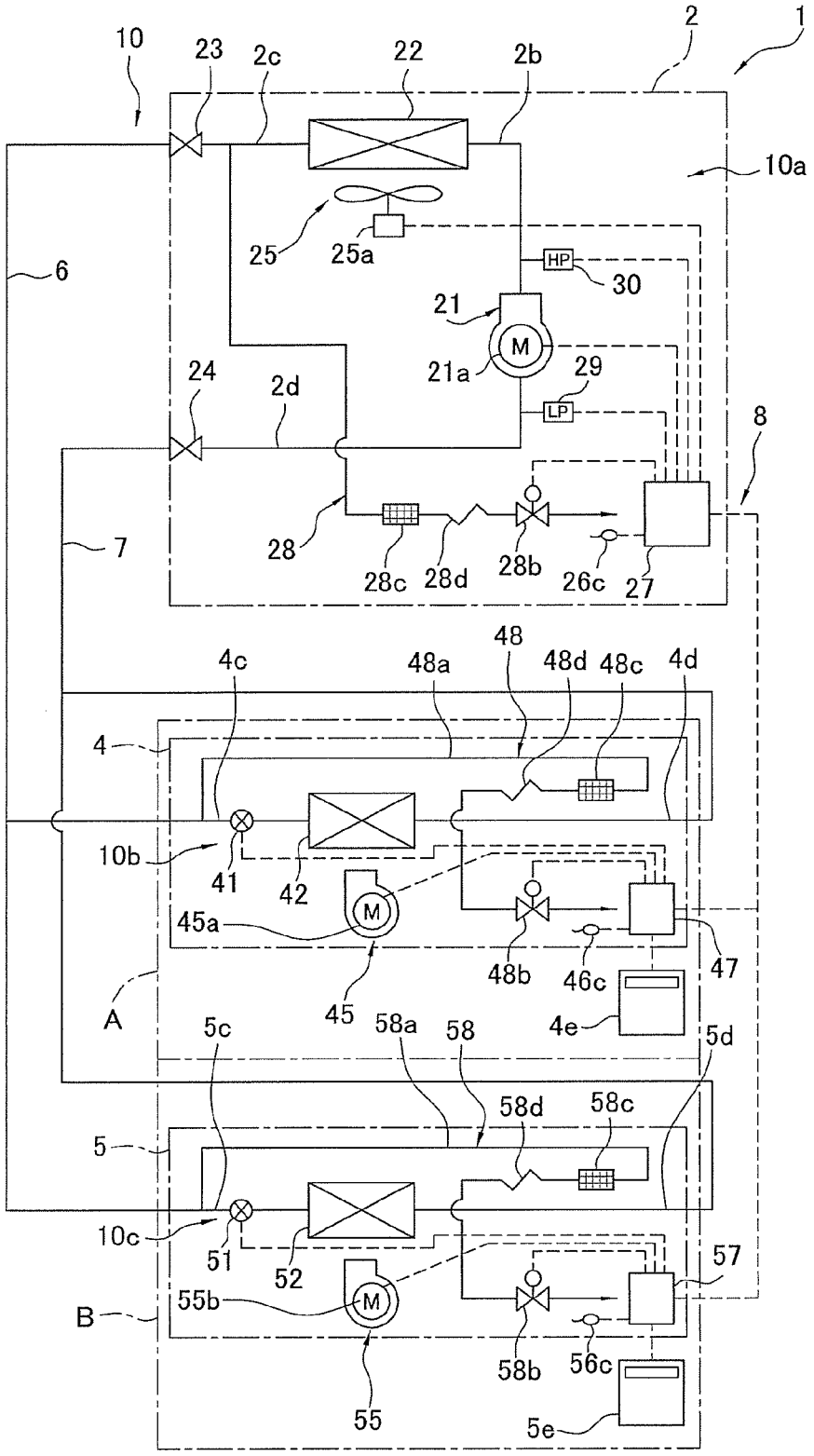
FIG. 20 is a schematic structural drawing of an air conditioning apparatus according to Modification 7 of Embodiment 1.

In the embodiment and Modifications 1 through 6 described above, the refrigerant emission pipe 28 provided to the outdoor unit 2 is connected to the low-pressure portion of the refrigerant circuit 10 through which the low-pressure refrigerant flows during the normal operation (specifically, to the refrigerant pipe 2*d* on the intake side of the compressor 21), and the refrigerant emission pipes 48, 58 provided to the indoor units 4, 5 are connected to the low-pressure portion of the refrigerant circuit 10 through which the low-pressure refrigerant flows during the normal operation (specifically, to the refrigerant pipes 4*d*, 5*d* on the outlet side of the indoor heat exchangers 42, 52 that function as evaporators, or to positions in the refrigerant pipes 4*c*, 5*c* between the indoor expansion valves 41, 51 and the indoor heat exchangers 42, 52), as shown in FIGS. 1, 4 through 6, 12, 14, and 16; but the refrigerant emission pipes 28, 48, 58 may also be connected to the high-pressure portion of the refrigerant circuit 10 through which the high-pressure refrigerant flows during the normal operation. Specifically, the refrigerant emission pipe 28 provided to the outdoor unit 2 may be connected to the refrigerant pipe 2*b* on the discharge side of the compressor 21 or to the refrigerant pipe 2*c* on the outlet side of the outdoor heat exchanger 22 that functions as a cooler, and the refrigerant emission pipes 48, 58 provided to the indoor units 4, 5 may be connected to the refrigerant pipes 4*c*, 5*c* on the sides upstream of the indoor expansion valves 41, 51, as shown in FIGS. 19 and 20.

Thus, a large amount of the carbon dioxide can be emitted in a short amount of time, due to the refrigerant emission pipes 48, 58 being connected to the high-pressure portion of the refrigerant circuit 10 through which the high-pressure refrigerant flows during the normal operation.

Though not shown in the drawings, in cases in which the objective is to be able to emit a larger amount of the carbon dioxide in a shorter amount of time than in cases in which the carbon dioxide is emitted from one of either the high-pressure portion or the low-pressure portion, the refrigerant emission pipes 28, 48, 58 may be provided to both the low-pressure portion through which the low-pressure refrigerant flows and the high-pressure portion through which the high-pressure refrigerant flows during the normal operation in the refrigerant circuit 10.

Second Embodiment (1) Configuration of Air Conditioning Apparatus

Figure 21:
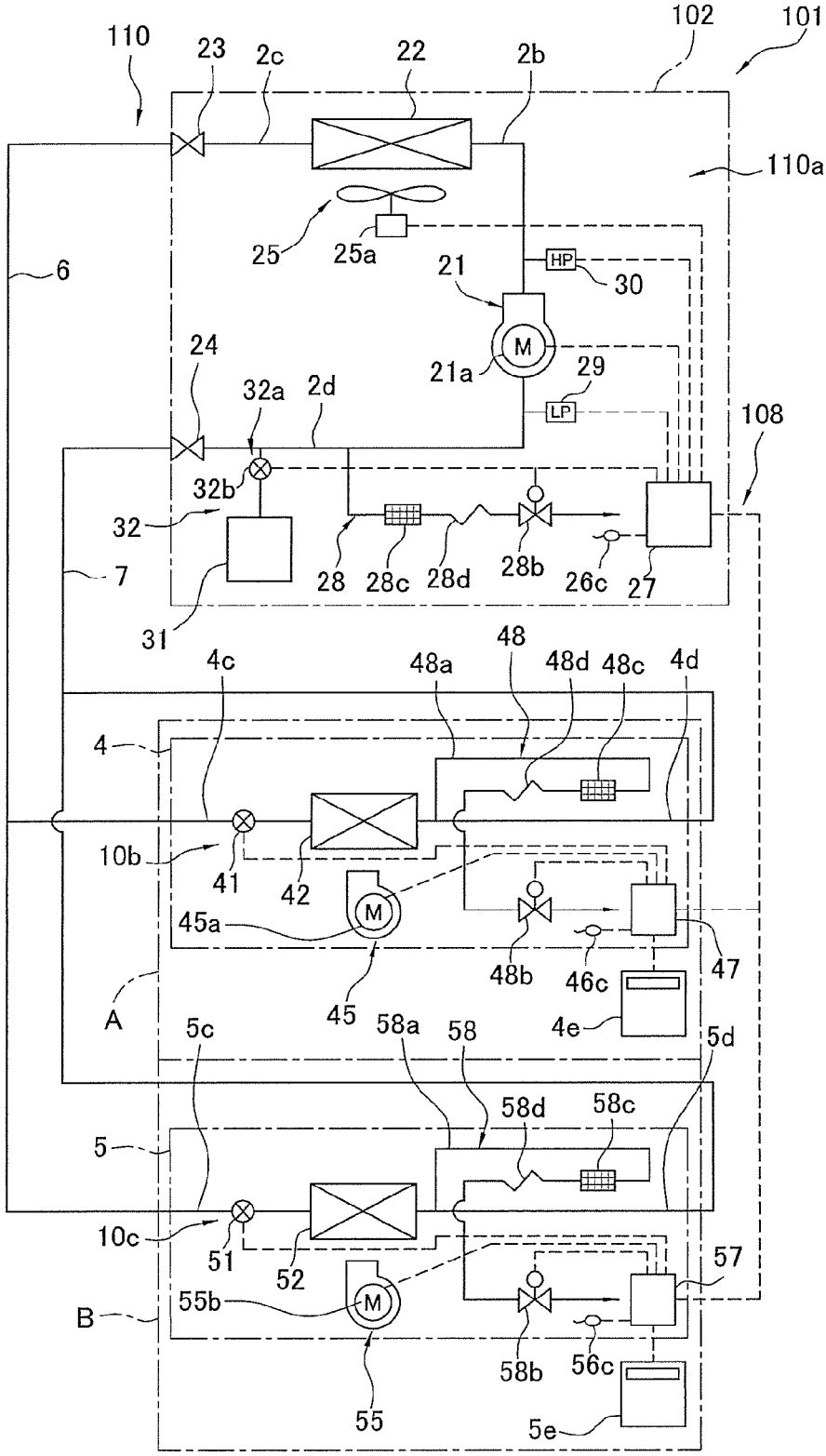
FIG. 21 is a schematic structural drawing of an air conditioning apparatus according to Embodiment 2 of the present invention.

FIG. 21 is a schematic structural drawing of an air conditioning apparatus 101 according to the second embodiment of the present invention. Similar to the air conditioning apparatus 1 according to embodiment 1, the air conditioning apparatus 101 is an apparatus used to cool the interiors of buildings and the like by performing a vapor compression refrigeration cycle operation, and mainly comprises an outdoor unit 102, a plurality (two in this case) of indoor units 4, 5, and refrigerant communication pipes 6, 7 for connecting the outdoor unit 102 with the indoor units 4, 5, constituting a refrigerant circuit 110 that uses carbon dioxide as a refrigerant. Similar to the air conditioning apparatus 1 according to embodiment 1, the air conditioning apparatus 101 according to the present embodiment is provided with refrigerant emission pipes 28, 48, 58 as refrigerant emission means that can emit the carbon dioxide from the refrigerant circuit 110 to an electric component assembly. In the following description of the configuration of the air conditioning apparatus 101, only the configuration of the outdoor unit 102 having a different configuration from the air conditioning apparatus 1 according to embodiment 1 is described, and the descriptions of the configurations of the indoor units 4, 5 and the refrigerant communication pipes 6, 7, which have the same configurations as in embodiment 1, are omitted.

(Outdoor Unit)

The outdoor unit 102 is connected to the indoor units 4, 5 via the refrigerant communication pipes 6, 7, constituting the refrigerant circuit 110 between the indoor units 4, 5.

Next, the configuration of the outdoor unit 102 will be described, but since the unit configuration of the outdoor unit 102 is the same as that of the outdoor unit 2 according to embodiment 1 except for a refrigerant storage container 31 and a refrigerant filling pipe 32 (described hereinafter) being provided with, descriptions are omitted herein and only the configuration of the refrigerant circuit is described.

The outdoor unit 102 is provided with an outdoor-side refrigerant circuit 110*a* constituting part of the refrigerant circuit 110. This outdoor-side refrigerant circuit 110*a* has a compressor 21, an outdoor heat exchanger 22 as a cooler, shut-off valves 23, 24, and a refrigerant emission pipe 28 as a refrigerant emission means. The compressor 21, the outdoor heat exchanger 22, the shut-off valves 23, 24, and the refrigerant emission pipe 28 are the same as the compressor 21, the outdoor heat exchanger 22, the shut-off valves 23, 24, and the refrigerant emission pipe 28 constituting the outdoor-side refrigerant circuit 10*a* according to embodiment 1, and are therefore not described herein.

Unlike the outdoor-side refrigerant circuit 10*a* according to embodiment 1, the outdoor-side refrigerant circuit 110*a* is provided with the refrigerant storage container 31 in which carbon dioxide as a refrigerant is stored, and the refrigerant filling pipe 32 for communicably or blockably connecting the refrigerant storage container 31 to the refrigerant circuit 110. The refrigerant storage container 31 is a container for storing, from the time the outdoor unit 2 is shipped, the refrigerant (specifically, carbon dioxide) needed for refrigerant filling in accordance with the piping capacity of the refrigerant communication pipes 6, 7 erected on site in the location where the air conditioning apparatus 101 is installed. The refrigerant filling pipe 32 has a communication pipe 32*a* for connecting the refrigerant storage container 31 with the refrigerant circuit 10 (the refrigerant pipe 2*d* on the intake side of the compressor 21 in this case), and a filling valve 32*b* connected to the communication pipe 32*a*. The filling valve 32*b* is a valve that is opened when the refrigerant storage container 31 and the refrigerant circuit 10 are communicated, and is composed of an electrical expansion valve in the present embodiment.

As described above, the indoor-side refrigerant circuits 10*b*, 10*c*, the outdoor-side refrigerant circuit 110*a*, and the refrigerant communication pipes 6, 7 are connected, constituting the refrigerant circuit 110 of the air conditioning apparatus 101. In the air conditioning apparatus 101 of the present embodiment, a control unit 108 as a control means for performing various operation controls for the air conditioning apparatus 101 is configured by the indoor-side control units 47, 57 and the outdoor-side control unit 37. The control unit 108 is connected so as to be capable of receiving signals from the remote controllers 4*e*, 5*e* and sensor signals from the various sensors 26*c*, 29, 30, 46*c*, 56*c*, and is also connected so as to be capable of controlling the various devices and valves 21, 25, 28*b*, 41, 45, 48*b*, 51, 55, 58*b*, 32*b* on the basis of these signals and the like.

(2) Operation of Air Conditioning Apparatus

Next, the operation of the air conditioning apparatus 101 of the present embodiment will be described. The normal operation in the air conditioning apparatus 101 of the present embodiment is the same as the normal operation in the air conditioning apparatus 1 of embodiment 1, and is therefore not described herein. In the air conditioning apparatus 101 of the present embodiment, during a test operation or the like after the air conditioning apparatus 101 is installed in the installation location and the refrigerant circuit 110 is configured, a refrigerant filling operation for filling the refrigerant circuit 110 with the carbon dioxide inside the refrigerant storage container 31 can be performed until the amount of the refrigerant in the refrigerant circuit 110 reaches a specific amount in accordance with the piping capacity of the refrigerant communication pipes 6, 7. The operation of the air conditioning apparatus 101 during this refrigerant filling operation is described hereinbelow.

(Refrigerant Filling Operation)

Figure 22:
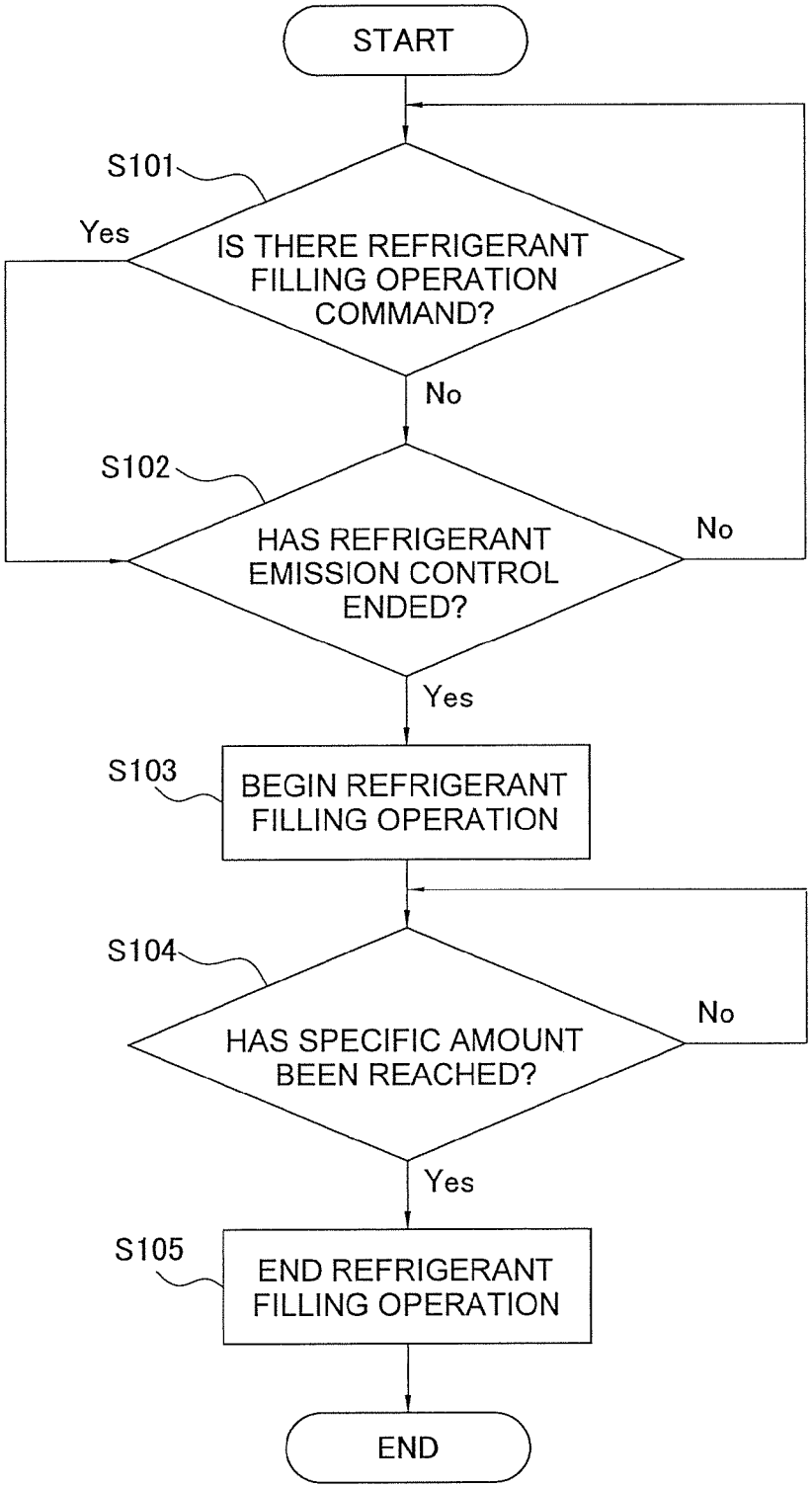
FIG. 22 is a flowchart of a refrigerant filling control according to Embodiment 2.

The operation of the air conditioning apparatus 101 during the refrigerant filling operation is described using FIGS. 21 and 22. A control for the various structural devices during the refrigerant filling operation is performed by the control unit 108 of the air conditioning apparatus 101, which functions as a refrigerant filling control means. FIG. 22 is a flowchart of the refrigerant filling operation in the present embodiment.

When the shut-off valves 23, 24 are full open and an operation command for the refrigerant filling operation is sent from the remote controllers 4*e*, 5*e* or the units 102, 4, 5 (step S101), the process advances to step S103 (for step S102, refer to the operation description for the refrigerant emission operation, given hereinunder). The filling valve 32*b* is then opened to communicate the refrigerant storage container 31 with the refrigerant circuit 110, and the compressor drive motor 21*a* of the compressor 21, the fan drive motor 25*a* of the outdoor fan 25, and the fan drive motors 45*a*, 55*a* of the indoor fans 45, 55 are started up. In other words, the filling valve 32*b* is opened to communicate the refrigerant storage container 31 with the refrigerant circuit 110, in which state the same refrigeration cycle operation as in the normal operation is performed.

The carbon dioxide in the refrigerant storage container 31 is thereby filled into the refrigerant circuit 110. In cases in which the amount of refrigerant in the refrigerant circuit 10 at the start of filling is less than the specific amount, the intake pressure of the compressor 21 is less than the pressure during the normal operation, and the discharge pressure of the compressor 21 is greater than the pressure during the normal operation. This phenomenon can therefore be used to determine, for example, whether or not the amount of refrigerant in the refrigerant circuit 10 has reached the specific amount. This determination of whether or not the amount of the refrigerant in the refrigerant circuit 10 has reached the specific amount is not limited to the basis of the intake pressure or discharge pressure of the compressor 21 as described above, and various factors can be used as long as the determination is made based on the refrigerant flowing through the refrigerant circuit 110 or on quantities of state of the operations of the structural devices.

In step S104, in cases in which it is determined that the amount of the refrigerant in the refrigerant circuit 10 has reached a specific amount, the filling valve 32*b* is closed, the refrigerant storage container 31 and the refrigerant circuit 110 are blocked (step S105), and the refrigerant filling operation is ended.

(Refrigerant Emission Operation)

In the air conditioning apparatus 101 of the present embodiment, the refrigerant emission pipes 28, 48, 58 are provided, a refrigerant emission operation for emitting the carbon dioxide as a refrigerant from the refrigerant circuit 110 through the refrigerant emission pipe 28 as a refrigerant emission means to the electric component assembly 26, and fire extinguishing or cooling can be performed, when an abnormal temperature increase has occurred in the electric component assembly 26 of the outdoor unit 102, and a refrigerant emission operation for emitting the carbon dioxide as a refrigerant from the refrigerant circuit 110 through the refrigerant emission pipes 48, 58 as refrigerant emission means to the electric component assemblies 46, 56 and extinguishing fire or cooling can be performed when an abnormal temperature increase has occurred in the electric component assemblies 46, 56 of the indoor units 4, 5; both operations being performed via the refrigerant emission control by the control unit 108 of the air conditioning apparatus 101, which functions as an emission control means, similar to the air conditioning apparatus 1 of embodiment 1 (see FIG. 8).

However, after this refrigerant emission control has been performed, the amount of refrigerant in the refrigerant circuit 110 is reduced, which is not much of a problem if the reduction is a small amount, but in cases in which a large amount of the carbon dioxide as a refrigerant is emitted to the electric component assemblies 26, 46, 56, the amount of the refrigerant in the refrigerant circuit 110 falls far short of the specific amount, and the refrigerant insufficiency makes it difficult to achieve specific air-conditioning performance even in cases in which the electric component assemblies 26, 46, 56 are not damaged and operations can continue.

In view of this, in the air conditioning apparatus 101 of the present embodiment, regardless of commands for the refrigerant filling operation from the remote controllers 4*e*, 5*e* or the units 102, 4, 5 (specifically, step S101), in cases in which the control unit 108 as a refrigerant filling control means has determined that the refrigerant emission control (see FIG. 8) described above has ended (for example, cases in which the process in step S5 in FIG. 8 has been performed), as in step S102 of the refrigerant filling operation (see FIG. 22), the refrigerant filling operation described above is performed (refer to steps S103 through S105 in FIG. 22), and the carbon dioxide in the refrigerant storage container 31 can be filled into the refrigerant circuit 110 until the amount of refrigerant in the refrigerant circuit 110 reaches the specific amount.

Thus, in the air conditioning apparatus 101 of the present embodiment, the refrigerant storage container 31 is provided in order to perform the refrigerant filling operation for filling the refrigerant circuit 110 with carbon dioxide until the amount of the refrigerant in the refrigerant circuit 110 reaches the specific amount. Moreover, since the refrigerant filling operation can be performed even after the carbon dioxide is emitted from the refrigerant circuit 110 to the electric component assemblies 26, 46, 56 and the fire extinguishing or cooling of the electric component assemblies 26, 46, 56 is ended, an amount of carbon dioxide proportionate to the reduction by emission from the refrigerant circuit 110 can be replenished from the refrigerant storage container 31 to the refrigerant circuit 110, and the normal operation can be resumed.

(3) Modification 1

Figure 23:
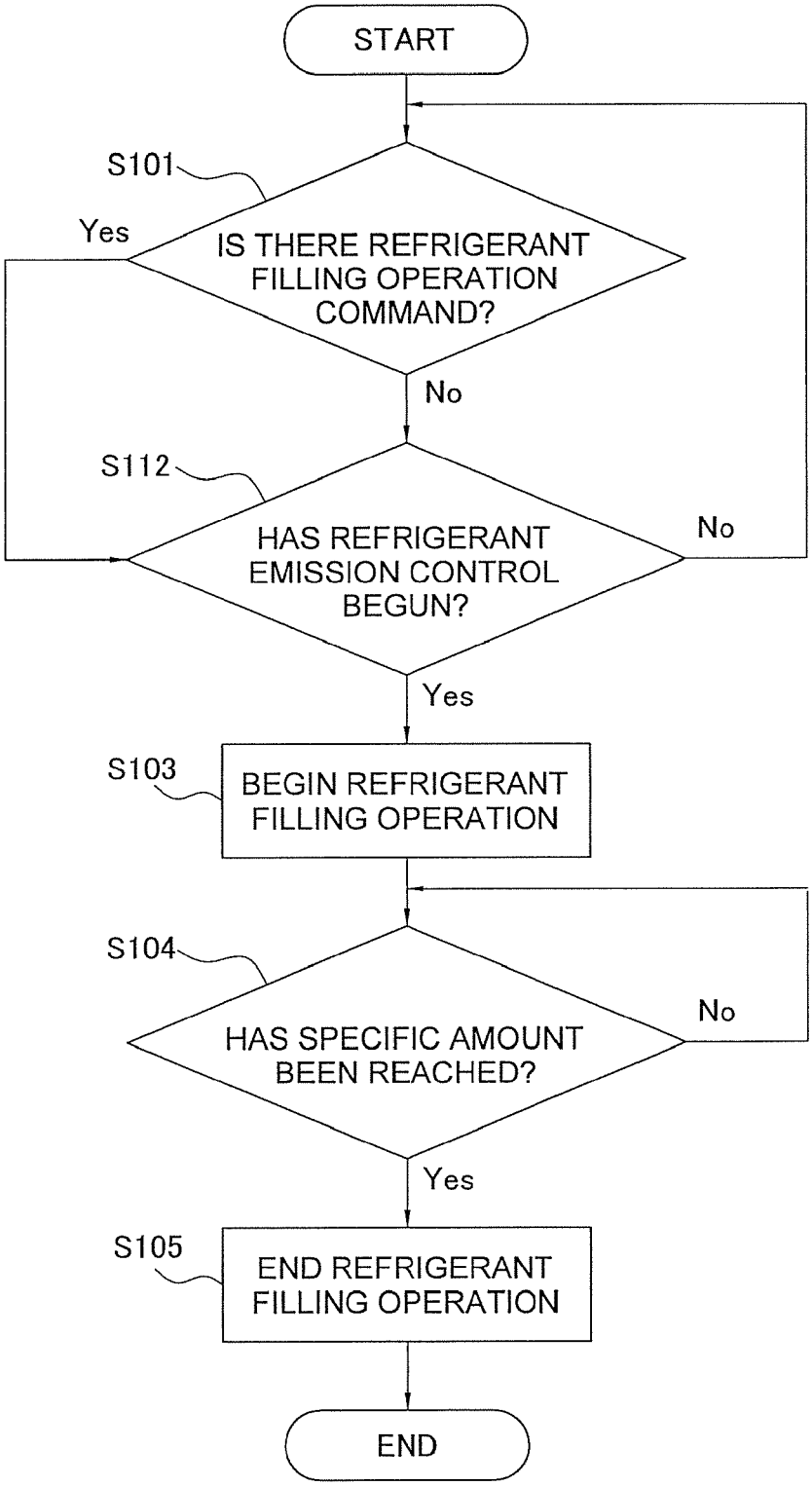
FIG. 23 is a flowchart of a refrigerant filling control according to Modification 1 of Embodiment 2.

In the embodiment described above, after the refrigerant emission operation has ended, an amount of carbon dioxide proportionate to the reduction by emission from the refrigerant circuit 110 can be replenished from the refrigerant storage container 31 to the refrigerant circuit 110 by performing the refrigerant filling operation, but in cases in which it is determined that the refrigerant emission control (see FIG. 8) has begun as in step S112 of the refrigerant filling operation (see FIG. 23)(for example, cases in which the processes in step S1, S2, and S3 in FIG. 8 have been performed), the refrigerant filling operation described above may be performed simultaneously with the refrigerant emission operation (refer to steps S103 through S105 of FIG. 23). The amount of refrigerant is thereby not likely to become insufficient in the refrigerant emission operation, and the amount of refrigerant in the refrigerant circuit 110 can be replenished to the specific amount either at the point the refrigerant emission operation ends or during a period soon after the refrigerant emission operation ends. Therefore, the normal operation can be quickly begun.

Thus, in the present modification, since the refrigerant storage container 31 is provided in order to perform the refrigerant filling operation for filling the refrigerant circuit 110 with carbon dioxide until the amount of refrigerant in the refrigerant circuit 110 reaches a specific amount, when the carbon dioxide is emitted from the refrigerant circuit 110 to the electric component assemblies 26, 46, 56, the refrigerant circuit 110 can be replenished with carbon dioxide from the refrigerant storage container 31 and the normal operation can be quickly resumed.

(4) Modification 2

The air conditioning apparatus 101 of the embodiment and Modification 1 described above has essentially the same configuration as the air conditioning apparatus 1 of embodiment 1, and differs only in that the refrigerant storage container 31 and the refrigerant filling pipe 32 for the refrigerant filling operation are added. Therefore, in the air conditioning apparatus 101 of the present embodiment and Modification 1, the configurations in Modifications 1 through 7 of embodiment 1 can also be applied. The details of applying the configurations of Modifications 1 through 7 of embodiment 1 to the air conditioning apparatus 101 of the present embodiment and Modification 1 are not described.

Other Embodiments

The embodiments and modifications of the present invention were described above with reference to the drawings, but the specific configurations are not limited to these embodiments and can be varied within a range that does not deviate from the scope of the invention.

(A)

In the embodiments and modifications described above, the present invention was applied to the air conditioning apparatus that uses indoor expansion valves 41, 51 composed of electrical expansion valves as expansion mechanisms, but the present invention is not limited to this option alone, and can also be applied to an air conditioning apparatus whose expansion mechanism is an expansion device that uses to isoentropically expand the refrigerant.

(B)

In the embodiments and modifications described above, the present invention was applied to a so-called cooling-specific type air conditioning apparatus whose normal operation is a cooling operation or a dehumidification operation, but the present invention is not limited to this option alone, and can also be applied to a heating-and-cooling-switching type air conditioning apparatus that can switch the normal operation between a cooling operation and a heating operation, or a heating-and-cooling-simultaneously-operated type air conditioning apparatus that can perform a cooling operation and a heating operation simultaneously as the normal operation.

(C)

In the embodiments and modifications described above, the present invention was applied to an air conditioning apparatus having one outdoor unit, but the present invention is not limited to this option alone, and can also be applied to an air conditioning apparatus to which a plurality of outdoor units are connected.

(D)

In the embodiments and modifications described above, the present invention was applied to a so-called multi-type air conditioning apparatus in which a plurality of indoor units are connected, but the present invention is not limited to this option alone, and can also be applied to a so-called pair-type air conditioning apparatus in which an indoor and an outdoor unit are paired.

(E)

In the embodiments and modifications described above, the present invention was applied to a ceiling mounted indoor unit, but the present invention is not limited to this option alone, and can also be applied to a duct type, a ceiling-suspended type, wall-mounted type, floor-mounted type, and various other types of indoor units.

(F)

In the embodiments and modifications described above, the present invention was applied to a so-called upward-blowing air-cooling outdoor unit in which outdoor air is blown above the outdoor unit, but the present invention is not limited to this option alone, and can also be applied to a water-cooling outdoor unit or a side-blowing air-cooling outdoor unit wherein outdoor air is blown to the side of the outdoor unit.

(G)

In the embodiments and modifications described above, the present invention was applied to a so-called separated air conditioning apparatus in which the indoor units and outdoor unit were connected via refrigerant communication pipes, but the present invention is not limited to this option alone, and can also be applied to an air conditioning apparatus in which the function of the indoor units and the function of the outdoor unit are configured within a single unit.

Industrial Applicability

If the present invention is used, it is possible to provide an air conditioning apparatus having the function of extinguishing fire when an electric component assembly ignites.

What is claimed is:

1. An air conditioning apparatus comprising:

a vapor compression refrigerant circuit, the vapor compression refrigerant circuit using carbon dioxide as a refrigerant;

an electric component assembly being configured to control an operation of structural devices;

a refrigerant emission device being configured to emit the carbon dioxide from the vapor compression refrigerant circuit to the electric component assembly;

a detection sensor that senses a quantity of state resulting from an abnormal temperature increase in the electric component assembly; and a emission control device that performs a refrigerant emission control, wherein a decision is made as to whether or not the abnormal temperature increase has occurred in the electric component assembly on the basis of the quantity of state sensed by the detection sensors, and the refrigerant emission device is operated so that the carbon dioxide is emitted from the vapor compression refrigerant circuit to the electric component assembly when a decision has been made that the abnormal temperature increase has occurred in the electric component assembly.

2. An air conditioning apparatus as recited in claim 1, wherein the refrigerant emission control is such that after the refrigerant emission device is operated so that the carbon dioxide is emitted from the vapor compression refrigerant circuit to the electric component assembly, a decision is made as to whether or not the abnormal temperature increase in the electric component assembly has been suppressed on the basis of the quantity of state detected by the detection sensor, and when a decision has been made that the abnormal temperature increase in the electric component assembly has not been suppressed, the refrigerant emission device is operated so that the amount of the carbon dioxide emitted increases further.

3. The air conditioning apparatus as recited in claim 1, wherein the refrigerant emission control is such that after the refrigerant emission device is operated so that the carbon dioxide is emitted from the vapor compression refrigerant circuit to the electric component assembly, a decision is made as to whether or not the abnormal temperature increase in the electric component assembly has been suppressed on the basis of the quantity of state detected by the detection sensor, and when it is determined that the abnormal temperature increase in the electric component assembly has been suppressed, the refrigerant emission control is ended.

4. The air conditioning apparatus as recited in claim 1, wherein the detection sensor is a temperature sensor that senses a temperature of the electric component assembly.

5. The air conditioning apparatus as recited in claim 1, wherein the vapor compression refrigerant circuit is configured by connecting an indoor unit and an outdoor unit via a refrigerant communication pipe, and the refrigerant emission device is provided to the indoor unit and/or the outdoor unit.

6. The air conditioning apparatus as recited in claim 1, wherein the vapor compression refrigerant circuit is configured by connecting a compressor, a cooler, an expansion mechanism, and an evaporator, a blowing fan configured to blow air as a heat source to the cooler and/or the evaporator is further included, the blowing fan is driven by a fan drive motor, the refrigerant emission device configured to emit the carbon dioxide from the vapor compression refrigerant circuit to the fan drive motor, and the refrigerant emission device is operated so that the carbon dioxide is emitted from the vapor compression refrigerant circuit to the fan drive motor when a decision has been made that the blowing fan has locked.

7. The air conditioning apparatus as recited in claim 1, wherein the vapor compression refrigerant circuit is configured by connecting a compressor, a cooler, an expansion mechanism, and an evaporator, the compressor is driven by a built-in compressor drive motor, the refrigerant emission device is configured to emit the carbon dioxide from the vapor compression refrigerant circuit to the compressor, and the refrigerant emission device is operated so that the carbon dioxide is emitted from the vapor compression refrigerant circuit to the compressor when a decision has been made that the compressor has locked.

8. The air conditioning apparatus as recited in claim 1, wherein the refrigerant emission device is configured to emit the carbon dioxide to the electric component assembly from a high-pressure portion of the vapor compression refrigerant circuit through which high-pressure refrigerant flows during a refrigeration cycle operation, or from a low-pressure portion of the vapor compression refrigerant circuit through which low-pressure refrigerant flows during the refrigeration cycle operation.

9. The air conditioning apparatus as recited in claim 1, wherein the refrigerant emission device is configured to emit the carbon dioxide to the electric component assembly from a high-pressure portion of the vapor compression refrigerant circuit through which high-pressure refrigerant flows during a refrigeration cycle operation, and from a low-pressure portion of the vapor compression refrigerant circuit through which low-pressure refrigerant flows during the refrigeration cycle operation.

10. The air conditioning apparatus as recited in claim 1, wherein the refrigerant emission device is operated so that the carbon dioxide is emitted intermittently from the vapor compression refrigerant circuit.

11. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the refrigerant emission device being operated so that the carbon dioxide is emitted intermittently from the vapor compression refrigerant circuit.

12. The air conditioning apparatus as recited in claim 11, wherein the refrigerant emission control is such that after the refrigerant emission device is operated so that the carbon dioxide is emitted from the vapor compression refrigerant circuit to the electric component assembly, a decision is made as to whether or not the abnormal temperature increase in the electric component assembly has been suppressed on the basis of the quantity of state detected by the detection sensor, and when a decision has been made that the abnormal temperature increase in the electric component assembly has not been suppressed, the refrigerant emission device is operated so that the amount of the carbon dioxide emitted increases further.

13. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the refrigerant emission device having a discharge nozzle connected to the vapor compression refrigerant circuit, and a discharge valve connected to the discharge nozzle, and an oil separation device being also connected to the discharge nozzle, the oil separation device being configured to separate refrigerator oil from the carbon dioxide when the carbon dioxide is emitted from the vapor compression refrigerant circuit to the electric component assembly.

14. The air conditioning apparatus as recited in claim 13, wherein the discharge nozzle opens into the electric component assembly.

15. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the vapor compression refrigerant circuit being configured by connecting an indoor unit and an outdoor unit via a refrigerant communication pipe, an interior of the outdoor unit being provided with a refrigerant storage container to store carbon dioxide as a refrigerant, the refrigerant storage container being communicably or blockably connected to the vapor compression refrigerant circuit, a refrigerant filling control device being further included to perform a refrigerant filling operation in which a refrigeration cycle operation of the vapor compression refrigerant circuit is performed in a state in which the refrigerant storage container is made to communicate with the vapor compression refrigerant circuit, and the vapor compression refrigerant circuit is filled with the carbon dioxide inside the refrigerant storage container until the amount of the refrigerant in the vapor compression refrigerant circuit reaches a specific amount, and the refrigerant filling control device performing the refrigerant filling operation after the emission of the carbon dioxide by the refrigerant emission device has ended.

16. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the vapor compression refrigerant circuit being configured by connecting an indoor unit and an outdoor unit via a refrigerant communication pipe, an interior of the outdoor unit being provided with a refrigerant storage container to store carbon dioxide as a refrigerant, the refrigerant storage container being communicably or blockably connected to the vapor compression refrigerant circuit, a refrigerant filling control device being further included to perform a refrigerant filling operation in which a refrigeration cycle operation of the vapor compression refrigerant circuit is performed in a state in which the refrigerant storage container is made to communicate with the vapor compression refrigerant circuit, and the vapor compression refrigerant circuit is filled with the carbon dioxide inside the refrigerant storage container until the amount of the refrigerant in the vapor compression refrigerant circuit reaches a specific amount, and the refrigerant filling control device allowing the carbon dioxide in the refrigerant storage container to flow into the vapor compression refrigerant circuit during the emission of the carbon dioxide by the refrigerant emission device.

17. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the vapor compression refrigerant circuit being configured by connecting a compressor, a cooler, an expansion mechanism, and an evaporator, a blowing fan being configured to blow air as a heat source to the cooler and/or the evaporator being further included, and the blowing fan and the compressor being stopped when the carbon dioxide is emitted by the refrigerant emission device.

18. An air conditioning apparatus comprising:

a vapor compression refrigerant circuit, the vapor compression refrigerant circuit using carbon dioxide as a refrigerant;

an electric component assembly being configured to control an operation of structural devices; and a refrigerant emission device being configured to emit the carbon dioxide from the vapor compression refrigerant circuit to the electric component assembly, the vapor compression refrigerant circuit being configured by connecting a compressor, a cooler, an expansion mechanism, and an evaporator, a blowing fan being configured to blow air as a heat source to the cooler and/or the evaporator being further included, and between the blowing fan and the compressor, the blowing fan alone being stopped when the carbon dioxide is emitted by the refrigerant emission device.

* * * * *